US010220399B2

(12) United States Patent
Beyda et al.

(10) Patent No.: US 10,220,399 B2
(45) Date of Patent: Mar. 5, 2019

(54) MULTI RESERVOIR DISPENSER

(71) Applicant: TOWN & COUNTRY LINEN CORP., New York, NY (US)

(72) Inventors: Jeffrey Beyda, New York, NY (US); Lou Henry, New York, NY (US); Chris Mellen, New York, NY (US); Gina Barnaba, New York, NY (US); Jennifer Roy, New York, NY (US)

(73) Assignee: TOWN & COUNTRY LINEN CORP., New York, NY (US)

( * ) Notice: Subject to any disclaimer, the term of this patent is extended or adjusted under 35 U.S.C. 154(b) by 0 days.

(21) Appl. No.: 15/626,863

(22) Filed: Jun. 19, 2017

(65) Prior Publication Data

US 2018/0361409 A1 Dec. 20, 2018

(51) Int. Cl.

| | |
|---|---|
| ***B05B 11/00*** | (2006.01) |
| ***B05B 1/16*** | (2006.01) |
| *B05B 7/24* | (2006.01) |

(52) U.S. Cl.

CPC ..... *B05B 11/0078* (2013.01); *B05B 1/1645* (2013.01); *B05B 11/3045* (2013.01); *B05B 11/3057* (2013.01); *B05B 11/3067* (2013.01); *B05B 7/2472* (2013.01)

(58) Field of Classification Search

CPC ..... B05B 11/0078; B05B 11/3045; B05B 11/3057; B05B 11/3067; B05B 1/1645; B05B 7/2472

See application file for complete search history.

(56) References Cited

U.S. PATENT DOCUMENTS

| | | | | |
|---|---|---|---|---|
| 3,760,986 | A | 9/1973 | Castner et al. | |
| 4,355,739 | A * | 10/1982 | Vierkotter | B05B 11/3083 222/134 |
| 5,009,342 | A | 4/1991 | Lawrence et al. | |
| 5,052,623 | A * | 10/1991 | Nordeen | B05B 7/2408 239/305 |
| 5,152,431 | A | 10/1992 | Gardner et al. | |
| 5,152,461 | A | 10/1992 | Proctor | |
| 5,332,157 | A * | 7/1994 | Proctor | B05B 11/0018 222/136 |
| 5,398,846 | A | 3/1995 | Corba et al. | |

(Continued)

*Primary Examiner* — Frederick C Nicolas
(74) *Attorney, Agent, or Firm* — Leason Ellis LLP

(57) ABSTRACT

A multi reservoir dispenser includes a first reservoir for holding a first fluid and a second reservoir for holding a second fluid. The dispenser further includes a pump mechanism that includes a pivotable trigger and a first plunger cavity that is disposed along the first flow path for receiving the first fluid and a second plunger cavity for receiving the second fluid. The pump mechanism also includes a first plunger that is disposed and movable within the first plunger cavity and a second plunger that is disposed and movable within the second plunger cavity. A selectable actuator is movable between: (a) a first position in which only the first plunger of the pump mechanism is actuated for discharging only the first fluid through a first orifice of a nozzle by causing the first fluid to flow along a first flow path; and (b) a second position in which only the second plunger of the pump mechanism is actuated for discharging only the second fluid through a second orifice of the nozzle by causing the second fluid to flow along a second flow path.

18 Claims, 29 Drawing Sheets

(56) References Cited

U.S. PATENT DOCUMENTS

| | | | | |
|---|---|---|---|---|
| 5,402,916 | A * | 4/1995 | Nottingham | B05B 11/3004 222/134 |
| 5,439,141 | A | 8/1995 | Clark et al. | |
| 5,609,299 | A * | 3/1997 | Foster | B05B 11/3011 222/137 |
| 5,626,259 | A * | 5/1997 | Maas | B05B 11/3011 222/136 |
| 5,752,626 | A * | 5/1998 | Bachand | B05B 1/3436 222/136 |
| 5,887,761 | A * | 3/1999 | Foster | B05B 11/007 222/383.1 |
| 5,906,318 | A | 5/1999 | Gurko, III et al. | |
| 6,550,694 | B1 * | 4/2003 | Foster | B05B 11/3011 222/137 |
| 6,869,027 | B2 * | 3/2005 | Foster | B05B 11/3009 222/383.1 |
| 7,875,001 | B2 * | 1/2011 | Minotti | A61M 15/08 222/137 |
| 9,192,949 | B2 * | 11/2015 | Lang | B05B 11/0018 |
| 2002/0031625 | A1 | 3/2002 | Walter, Jr. et al. | |

* cited by examiner

FLUID PUSH

FLUID PULL

FLUID PUSH

FLUID PULL 103
1012
MULTI
1010

1012
TILE
1010

340
310
103
GLASS
1010
1012

MULTI RESERVOIR DISPENSER

TECHNICAL FIELD

The present invention relates to dispensers that are configured to dispense a fluid and more particularly, to a dispenser, such as a spray bottle, that has multiple reservoirs with each reservoir having an independent, distinct flow path to a dispenser head orifice through which the fluid is expelled.

BACKGROUND

Dispensers find numerous uses both domestically and industrially for dispensing a variety of fluids. There are many different types of dispensers with one of the more popular liquid dispensers being a spray bottle. Spray bottles dispense a variety of fluids from plain liquids, such as water, alcohol, to complex liquid based compounds. Cleaning products, such as kitchen and bathroom cleaning products, are often dispensed through spray bottles.

Traditional spray bottles contain a single reservoir that holds a single fluid and include a spray bottle head that is actuated to dispense the fluid. The spray bottle head is typically made up of only a few parts including a trigger lever which activates a small pump. This pump is attached to a plastic tube that draws the fluid from the bottom of the reservoir (which can be in the form of a plastic bottle). The pump forces the liquid down a narrow barrel and out of a small hole formed in a nozzle piece, which is often adjustable to change the flow characteristics of the fluid. The fluid pump has a simple design in that the main moving element is a piston that is housed within a cylinder. Inside of this cylinder is a small spring. To operate the pump, the user pulls back the trigger which results in the piston being pushed into the cylinder. The moving piston compresses the spring so that when the user releases the trigger, the piston is pushed back out of the cylinder. These two strokes of the piston constitute the entire pump cycle.

The downstroke of the piston when the piston is pushed into the cylinder reduces the area of the cylinder and therefore, forces fluid out of the pump. Conversely, during the upstroke of the piston, the area within the cylinder is expanded and fluid is drawn into the cylinder. In order to accomplish the aforementioned actions, the spray bottle includes a one-way valve and more specifically, includes typically at least two one-way valves. The spray bottle can have two one-way valves in the pumping system, namely, a first one-way valve that is located between the pump and the reservoir and a second one-way valve that is located between the pump and the nozzle. Often, the one-way valve between the pump and the reservoir is in the form of a small rubber ball (or metal or plastic) that rests neatly inside a small seal. When no pumping action is occurring, the ball seats against the seal and the fluid passageway is blocked. During a pumping action when the user releases the trigger, the expanding area of the cylinder sucks the fluid below resulting in the ball being pulled out of the seal. Since the ball is not seated against the seal, the fluid is free to flow from the reservoir. However, when the trigger is squeezed, the dispensing force of expelling the fluid pushes the ball into the seat blocking off the passageway to the reservoir and as a result, the pressurized fluid is pushed only into the barrel.

The second one-way valve can be in the form of a cup-shaped structure that is located between the pump and the nozzle and fits over one end of the barrel. On the upstroke, the inward pressure of the pump pulls the cup against the barrel, thereby preventing air from flowing through the nozzle. Conversely, on the downstroke, the fluid pushing out lifts the cup off of the barrel slightly and flows on through the nozzle. Without this second one-way valve, the pump system would not be able to draw fluid up from the reservoir since this requires negative pressure (i.e., a drop in air pressure). With no one-way valve, the upstroke would not lower the air pressure in the pump. In many spray bottles, this second one-way valve also acts as a shut-off system in that when the nozzle piece is rotated (so as to screw the piece inward), the second one-way valve is pushed against the barrel and thereby, preventing any liquid from being forced out.

While there are multi-reservoir spray bottles in the prior art, most of these products are susceptible to fluid contamination in that the multiple reservoirs connect to a common part in the spray head in which comingling of the fluids can occur prior to discharge of the fluid. This is completely undesirable in many settings. For example, if one reservoir holds bleach and the other reservoir holds water, it is clearly not desirable and can be dangerous to dispense water that is contaminated with bleach residue. There is therefore, a need for a multi-reservoir dispenser, such as a spray bottle, that has completely separate plumbing for each fluid to be dispensed along the entire flow path from the reservoir to the nozzle.

SUMMARY

A multi reservoir dispenser includes a first reservoir for holding a first fluid and a second reservoir for holding a second fluid. The dispenser further includes a pump mechanism in fluid communication with the first reservoir via a first flow path and in fluid communication with the second reservoir via a second flow path. The pump mechanism includes a pivotable trigger and a first plunger cavity that is disposed along the first flow path for receiving the first fluid and a second plunger cavity for receiving the second fluid. The pump mechanism also includes a first plunger that is disposed and movable within the first plunger cavity and a second plunger that is disposed and movable within the second plunger cavity.

A nozzle is provided and has a first orifice in fluid communication with the first flow path and a second orifice in fluid communication with the second flow path. A selectable actuator is movable between: (a) a first position in which only the first plunger of the pump mechanism is actuated for discharging only the first fluid through the first orifice of the nozzle by causing the first fluid to flow along the first flow path; and (b) a second position in which only the second plunger of the pump mechanism is actuated for discharging only the second fluid through the second orifice of the nozzle by causing the second fluid to flow along the second flow path.

In accordance with the present invention, the first flow path and the second flow path are fluidly isolated from one another along an entire length from the first reservoir to the first orifice and from the second reservoir to the second orifice, respectively. In this way, cross-contamination between the two fluids is prevented.

BRIEF DESCRIPTION OF THE DRAWING FIGURES

Figure 1:
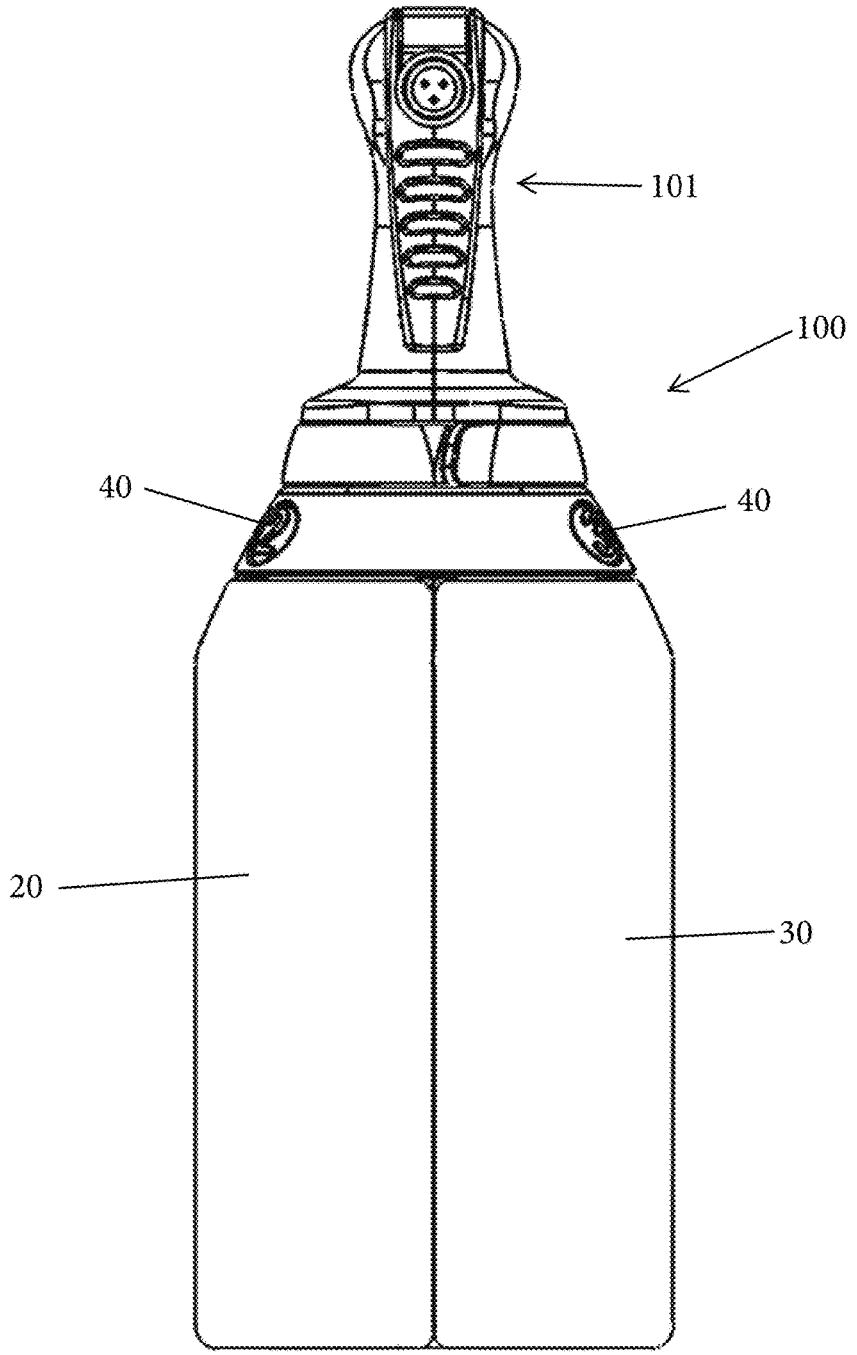
FIG. 1 is a front elevation view of a multi-reservoir dispenser (e.g., spray bottle) in accordance with one embodiment of the present invention.
Figure 2:
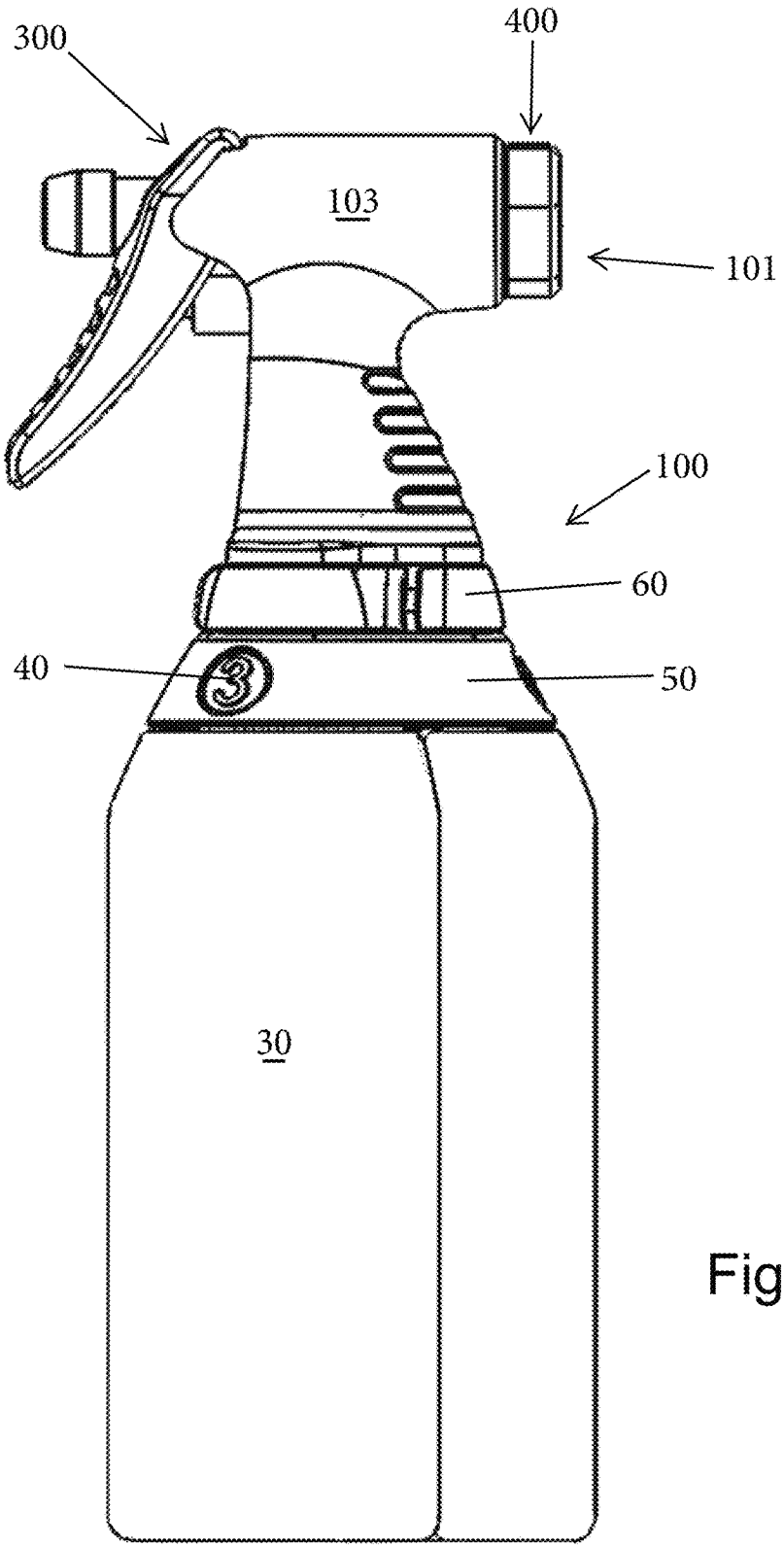
FIG. 2 is a first side elevation view thereof.
Figure 3:
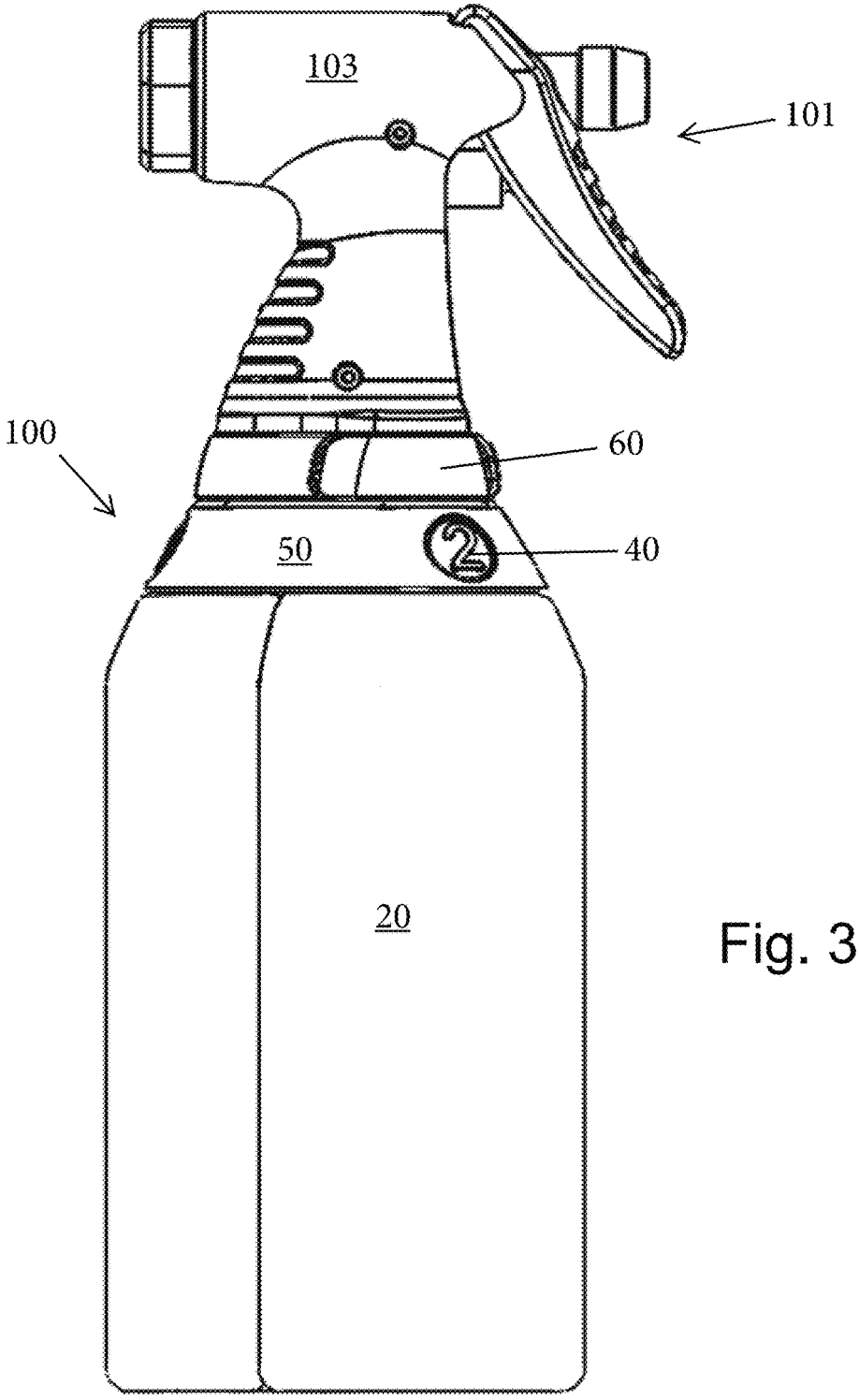
FIG. 3 is a second side elevation view thereof.
Figure 4:
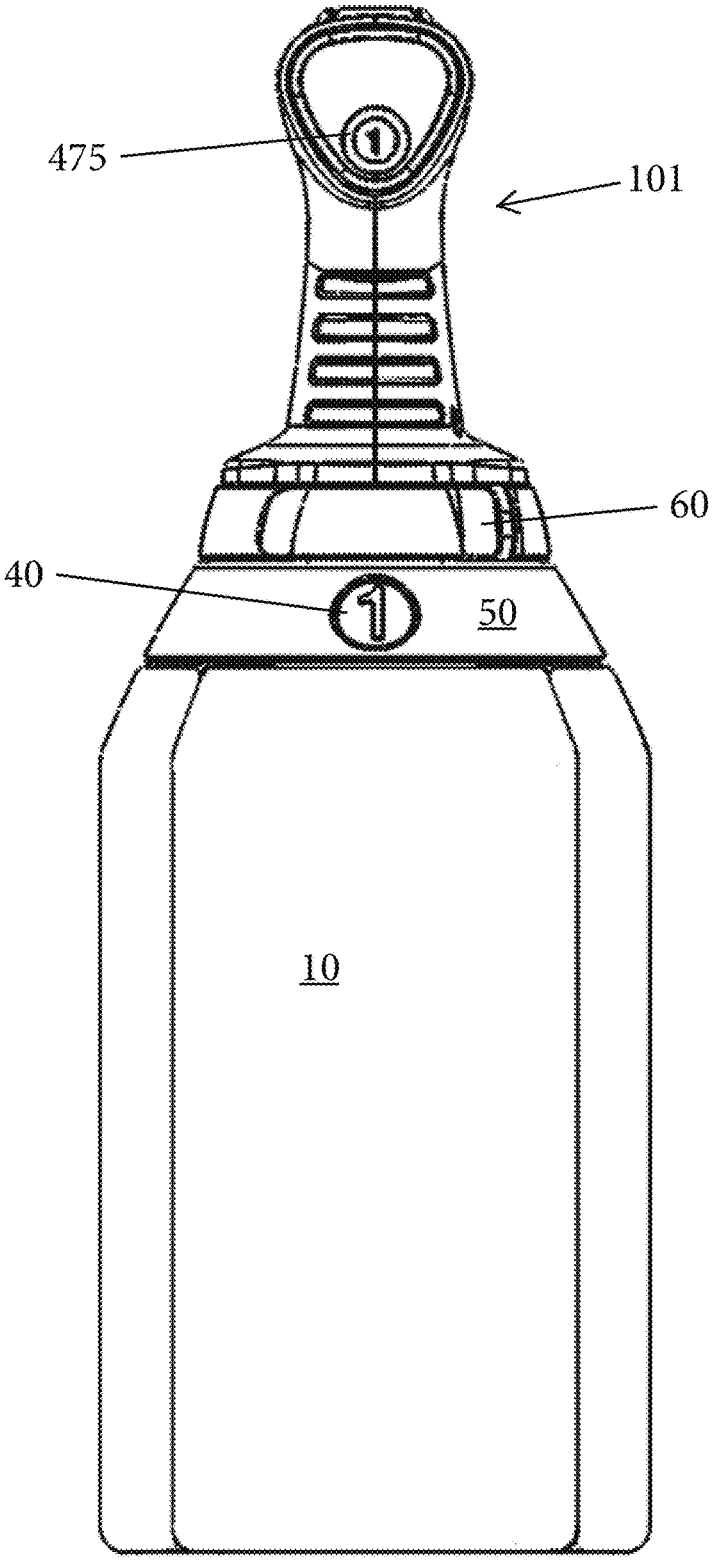
FIG. 4 is a rear elevation view thereof.
Figure 5:
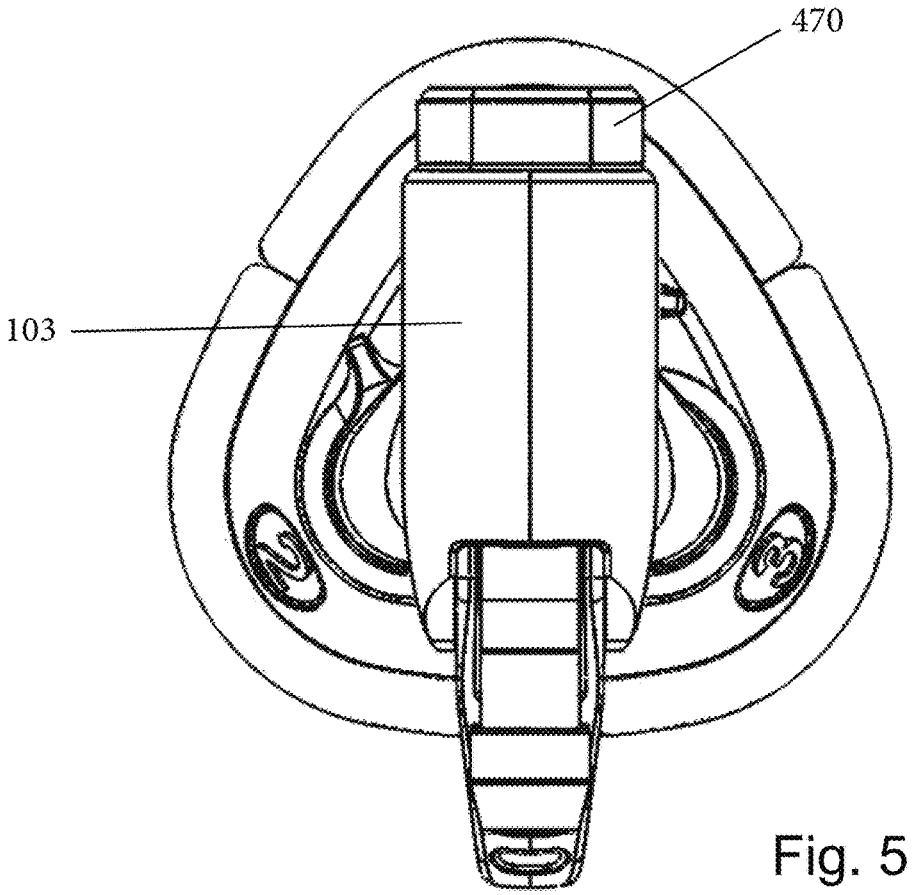
FIG. 5 is a top plan view thereof.
Figures 6A, 6B, 6C:
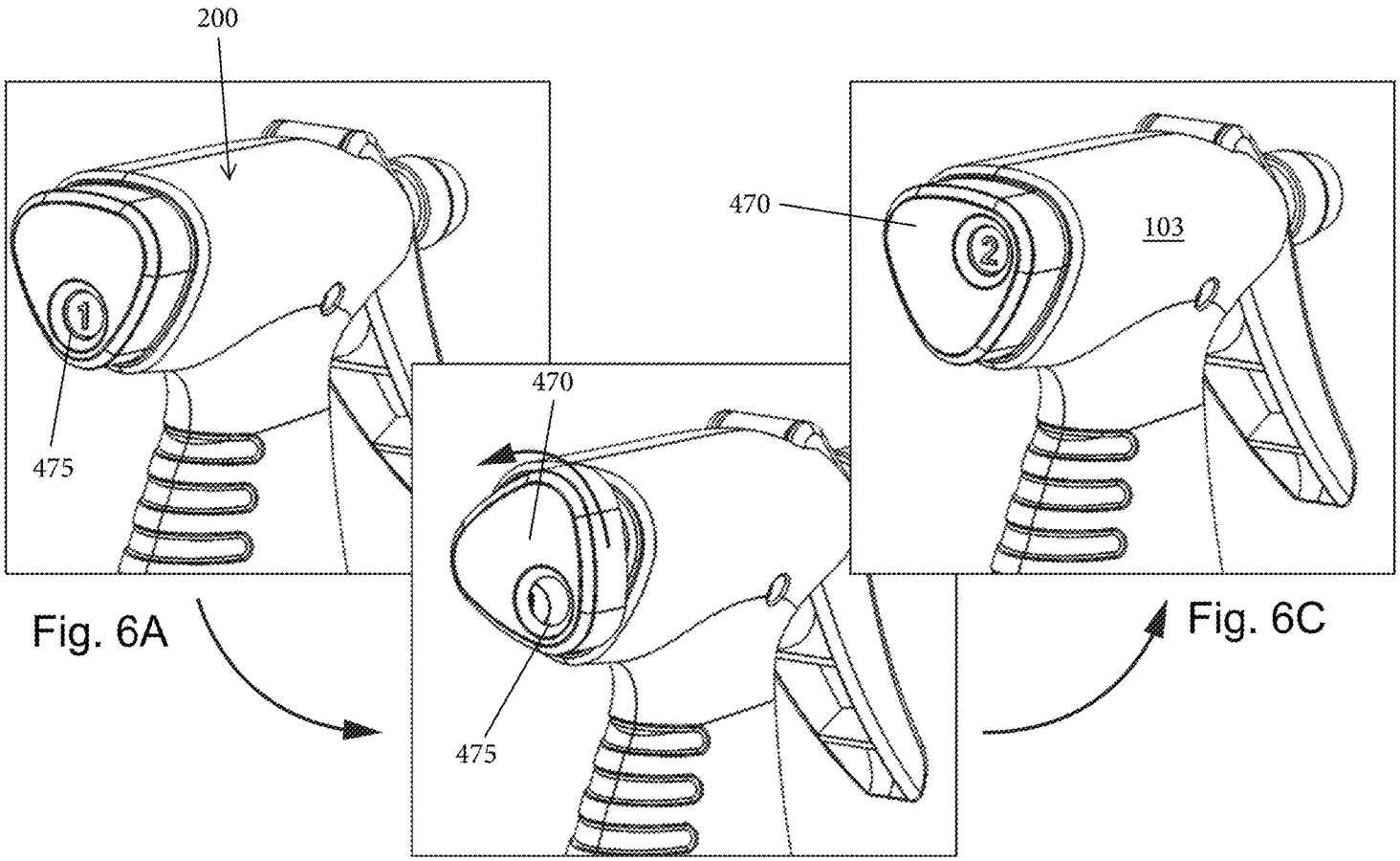
Figure 7:
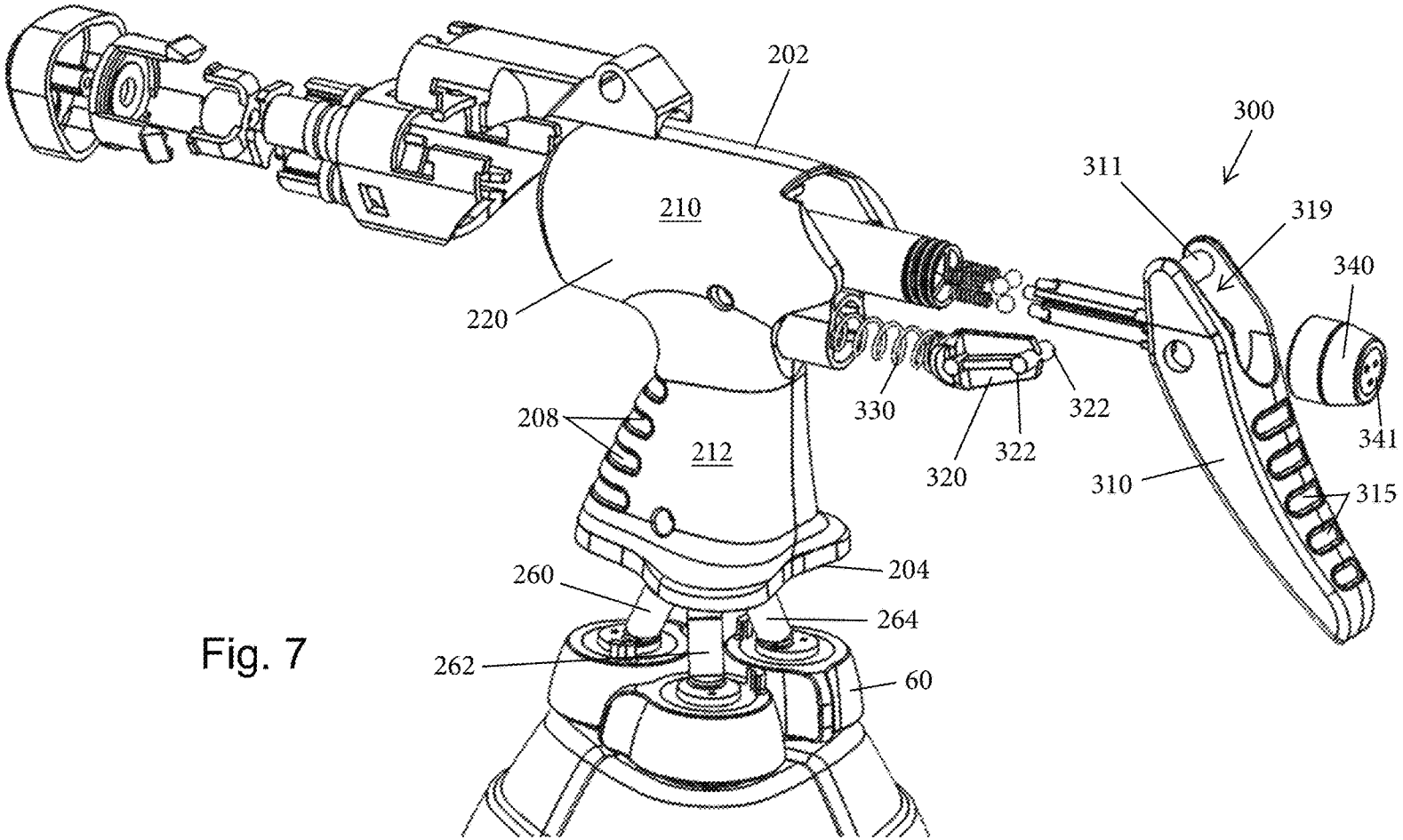
Figure 8:
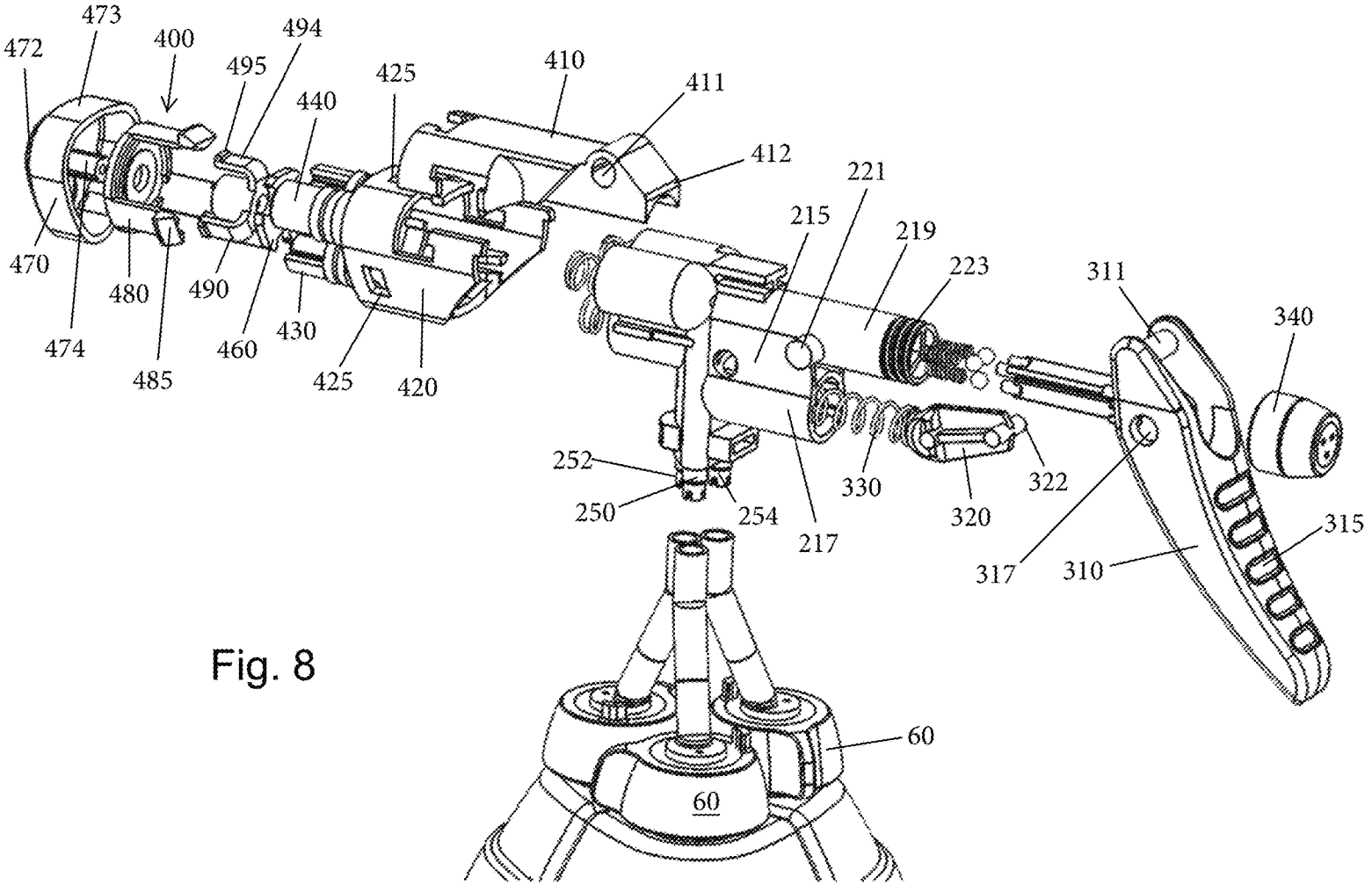
Figure 9:
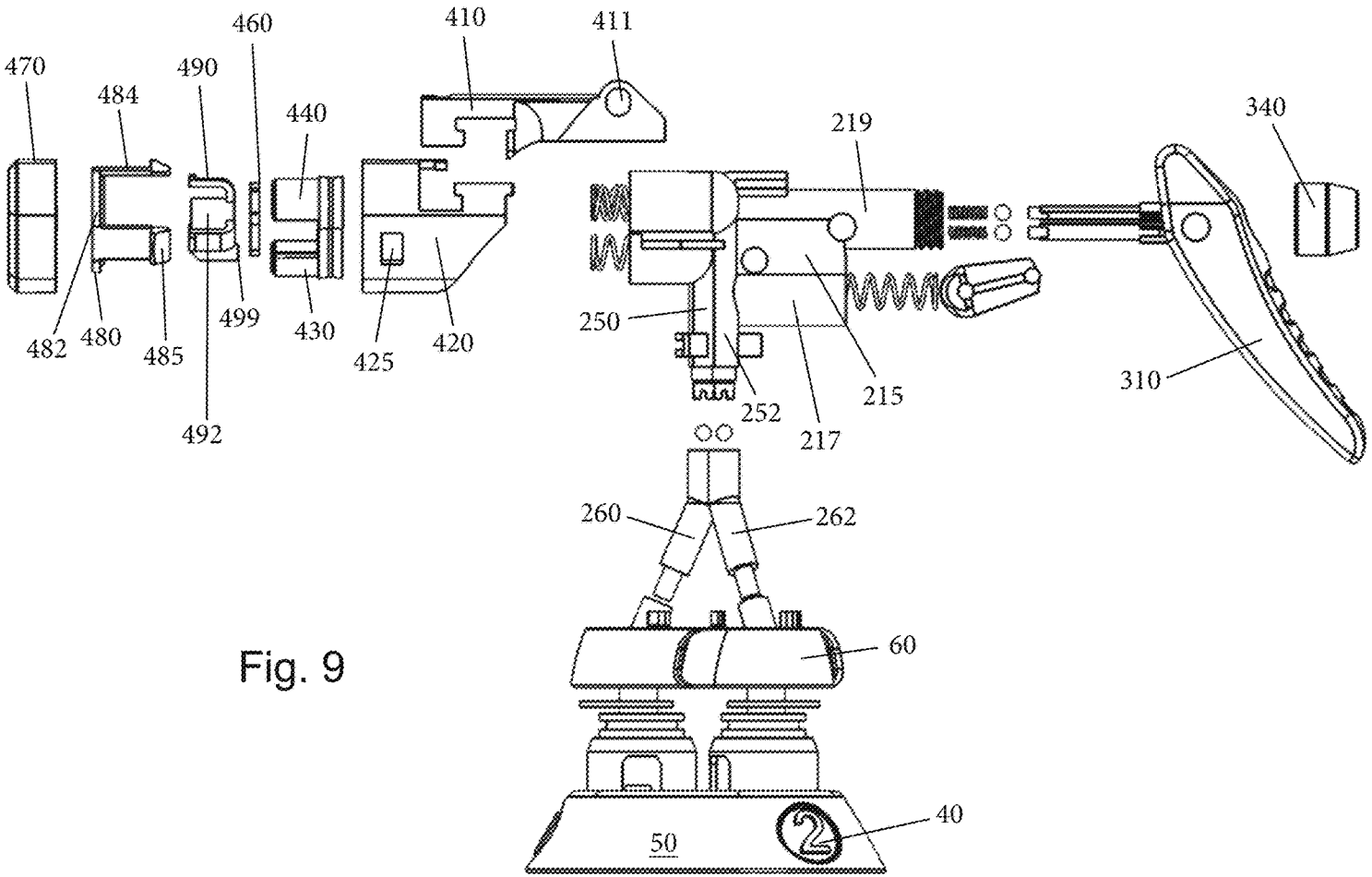
Figure 10:
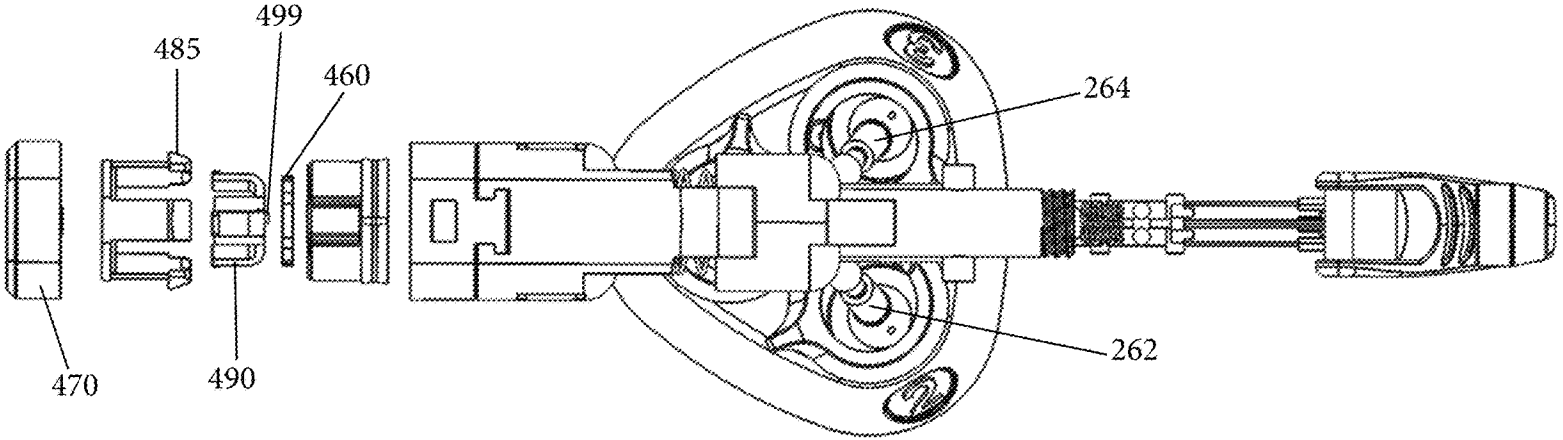
Figure 11B:
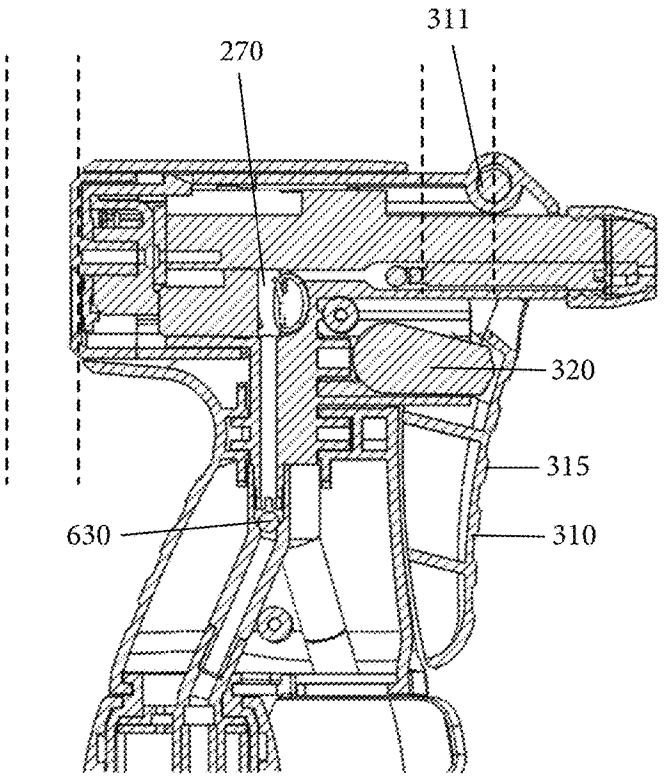
Figure 11A:
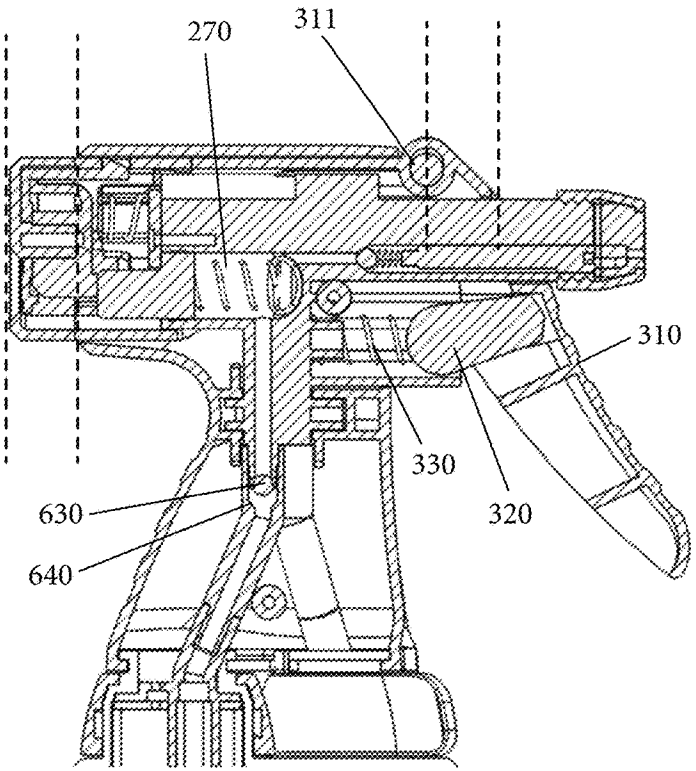
Figures 12A, 12B:
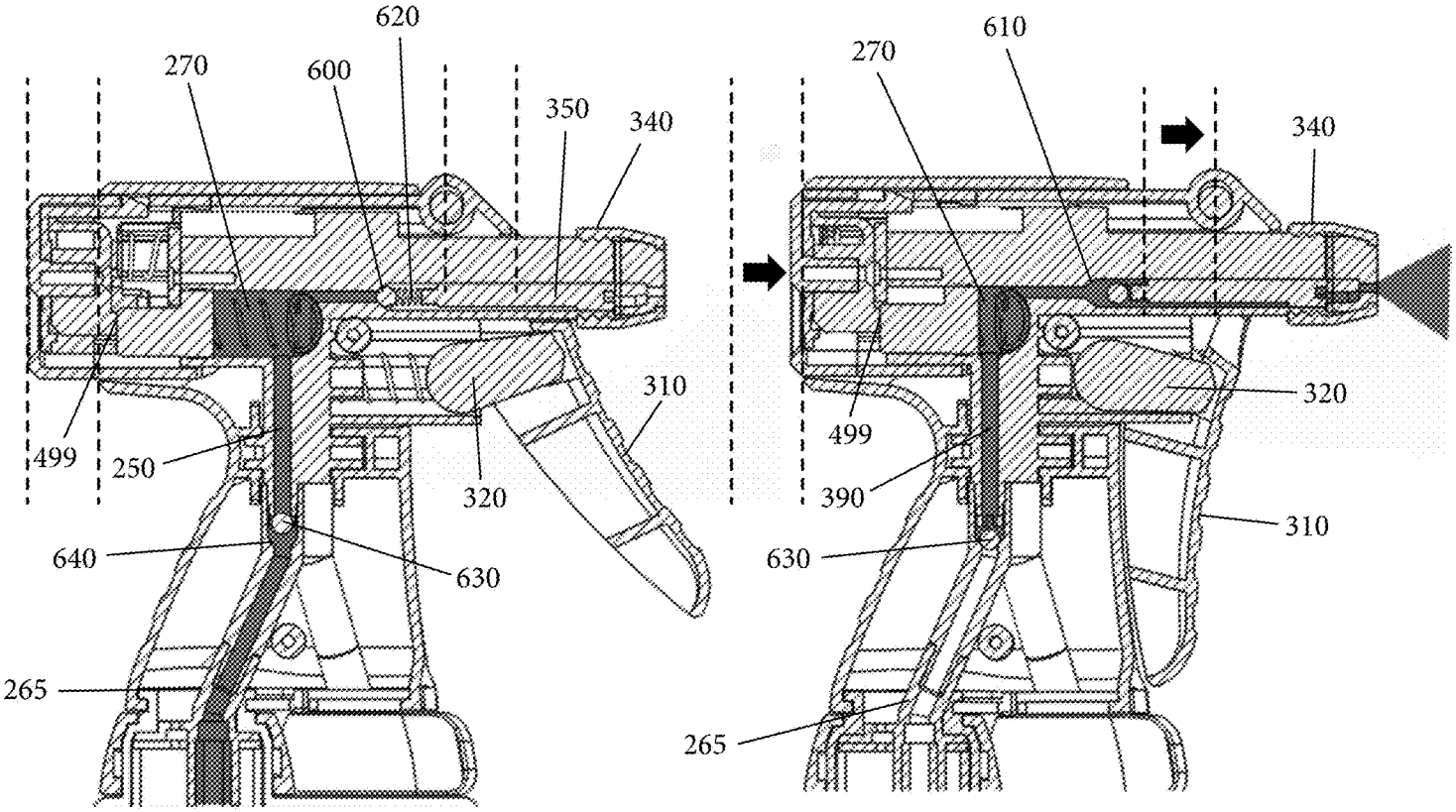
Figure 13:
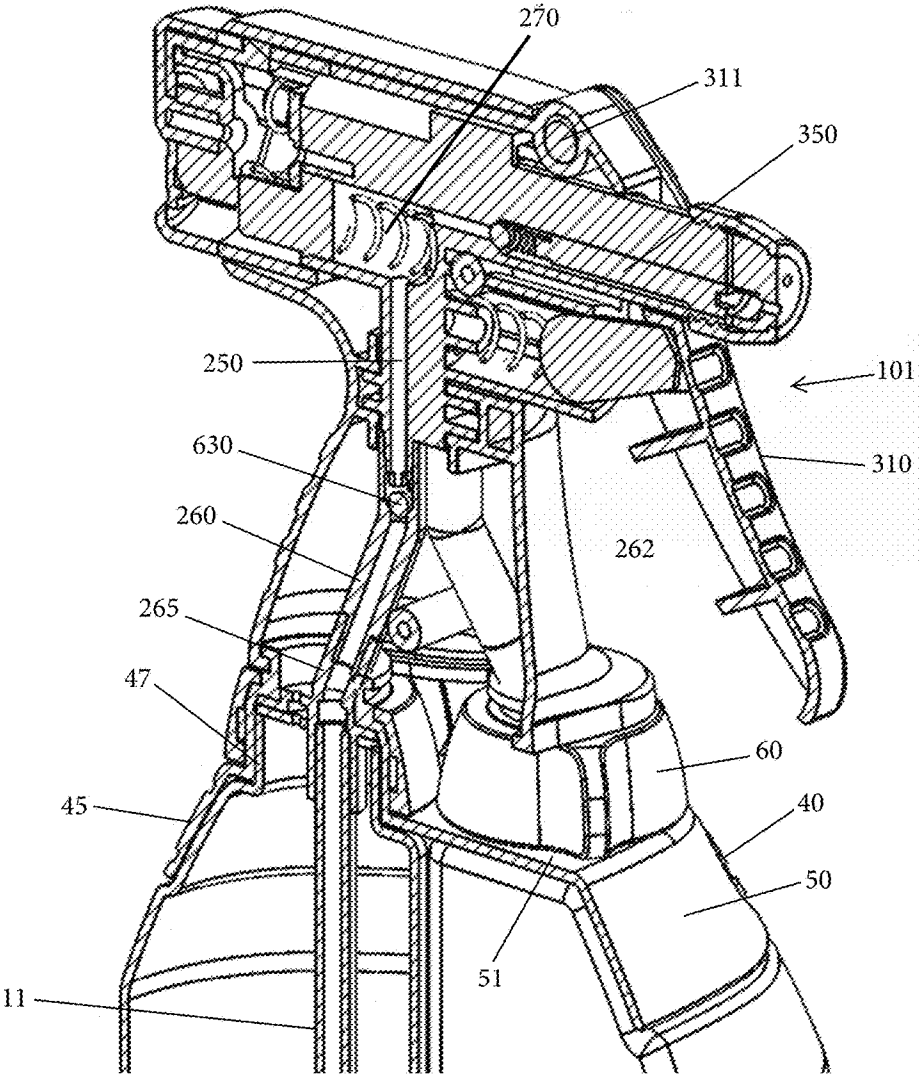
Figure 14:
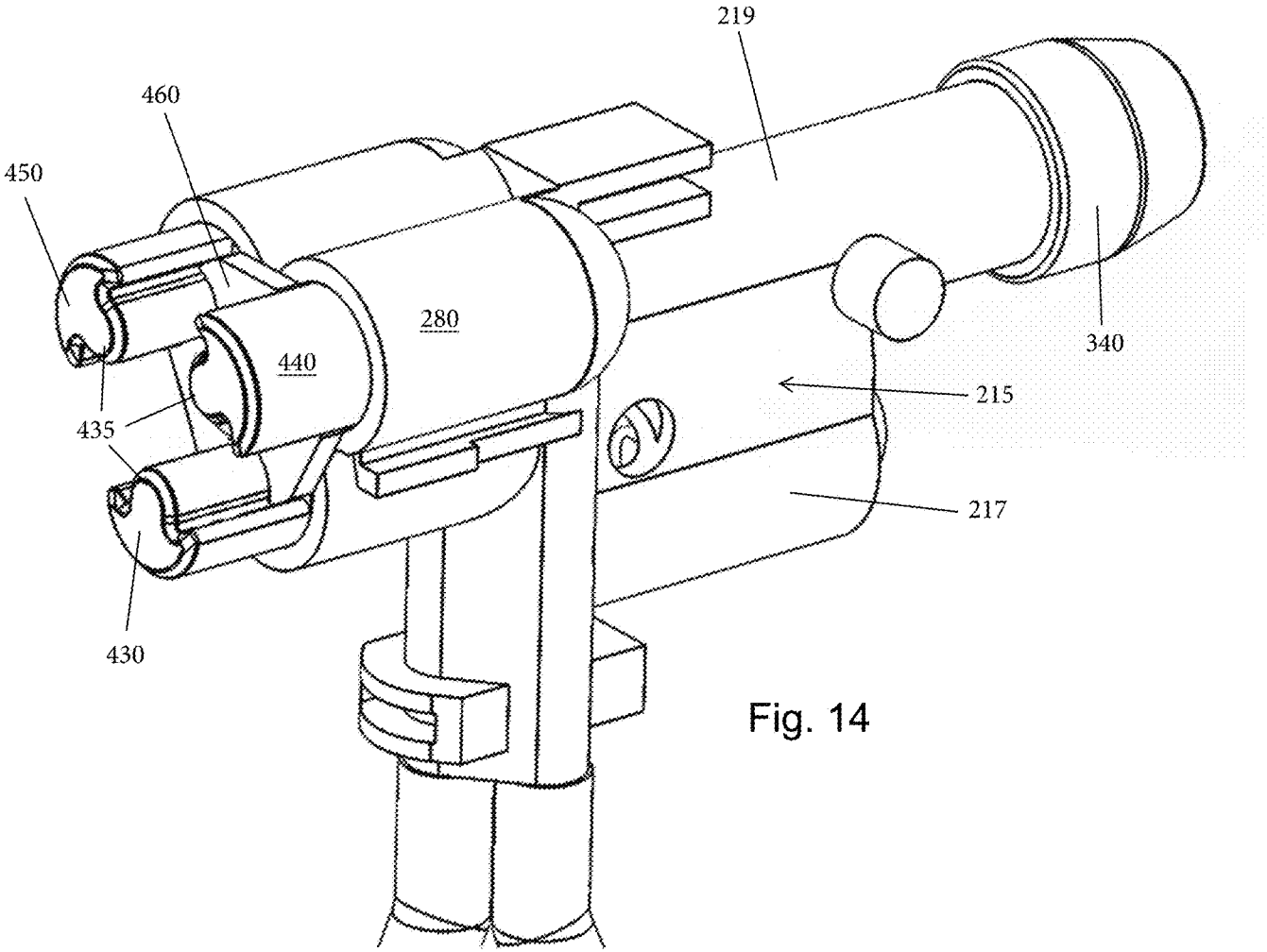
Figure 15:
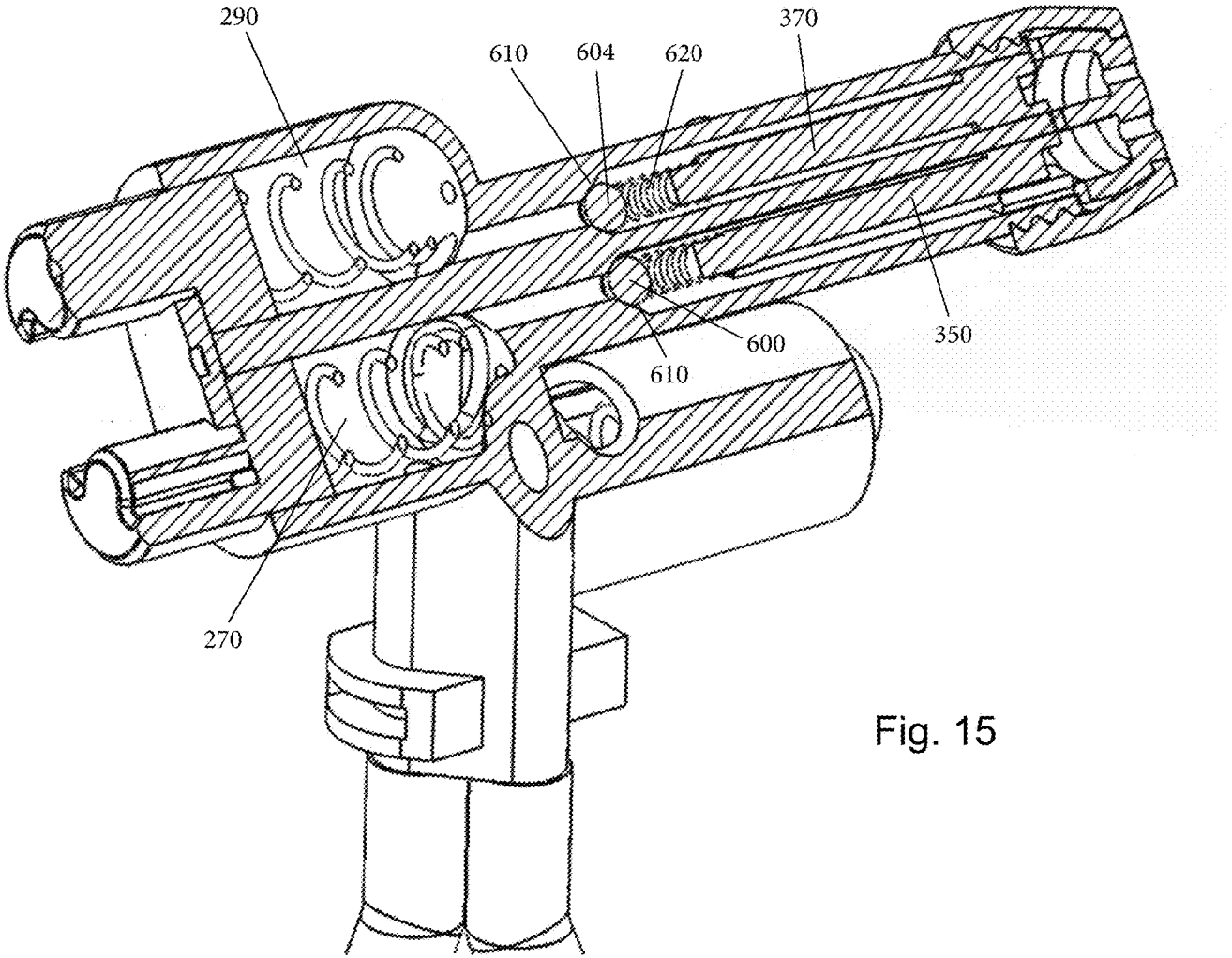
Figure 16:
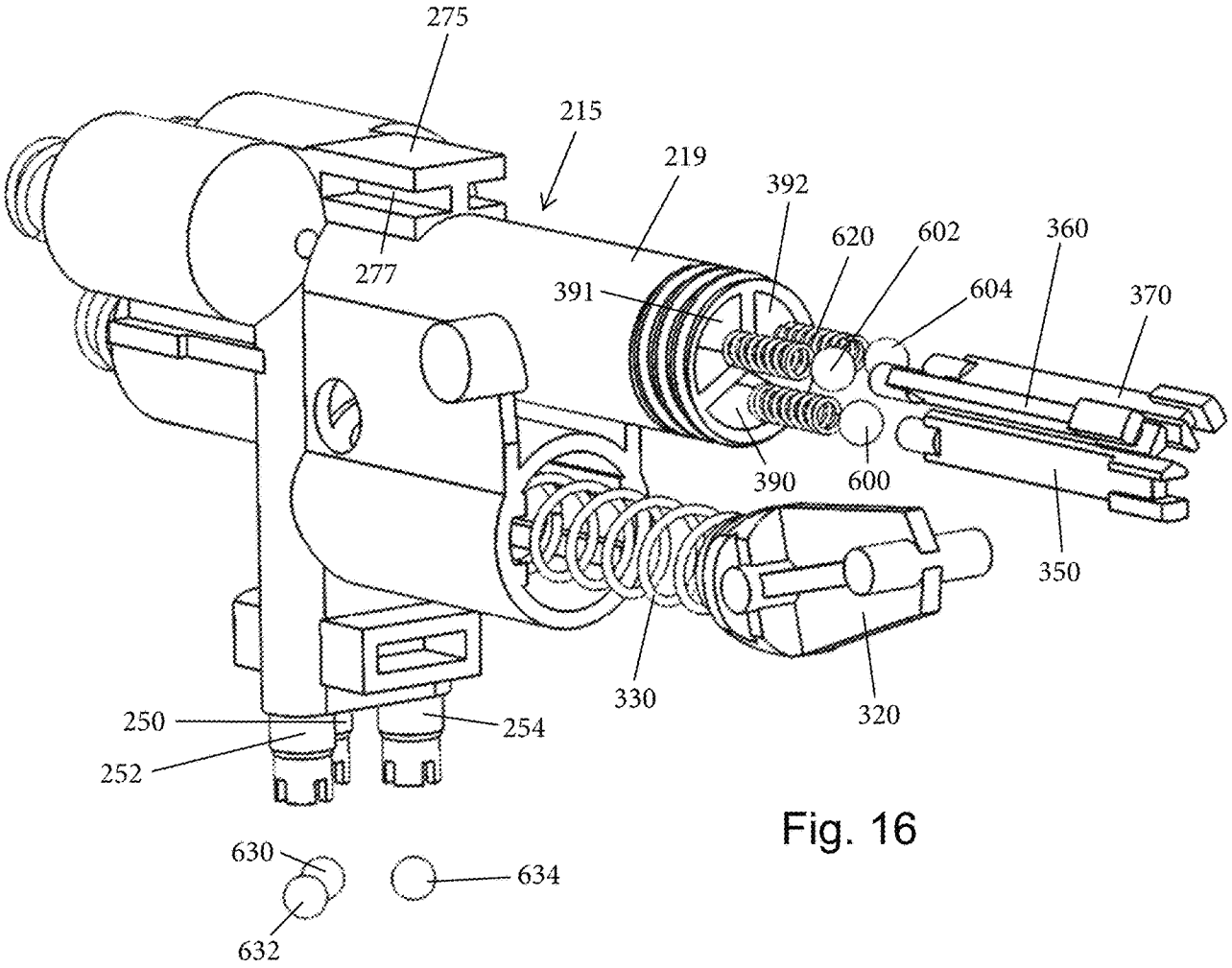
Figure 17:
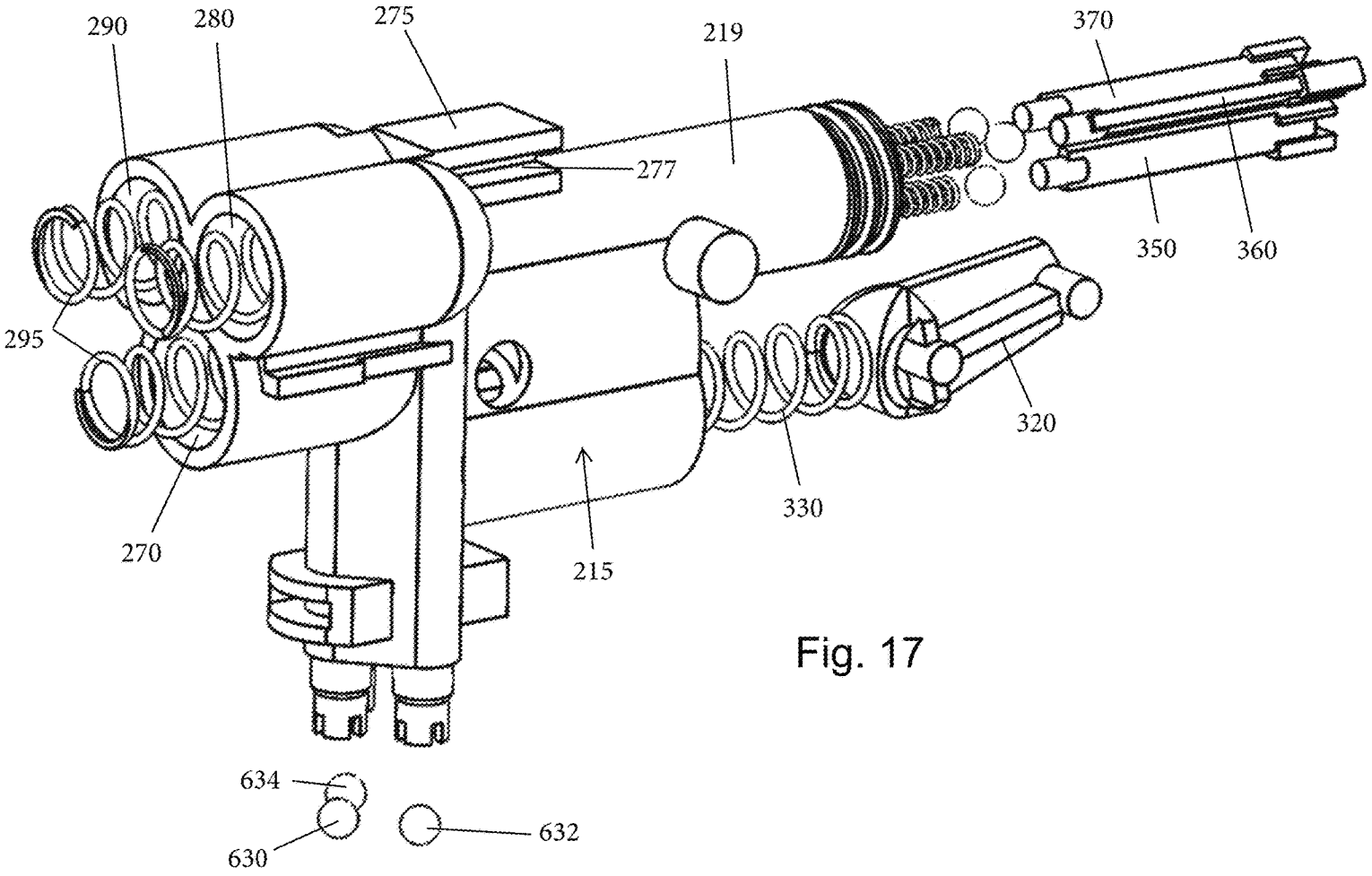
Figure 18B:
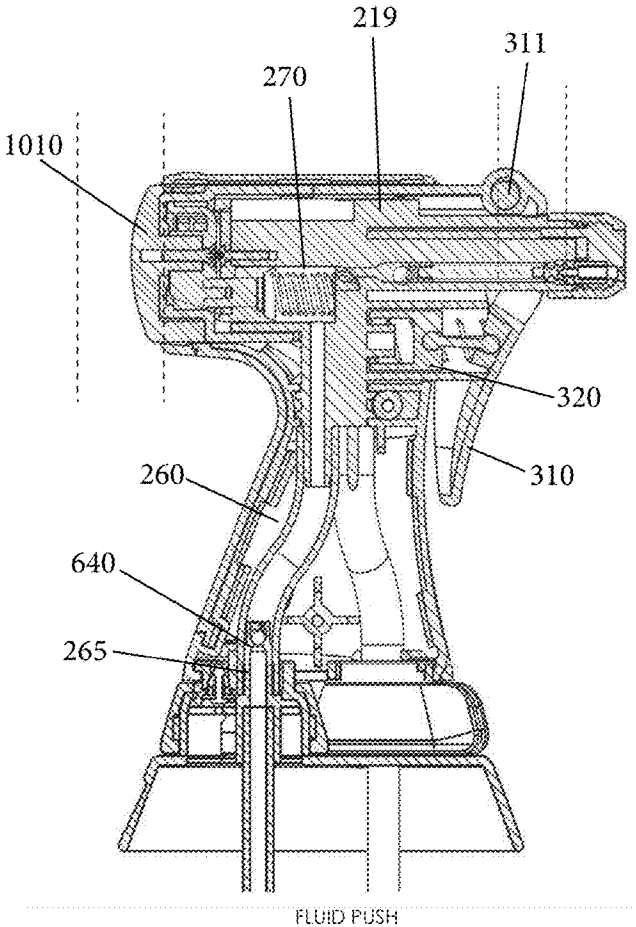
Figure 18A:
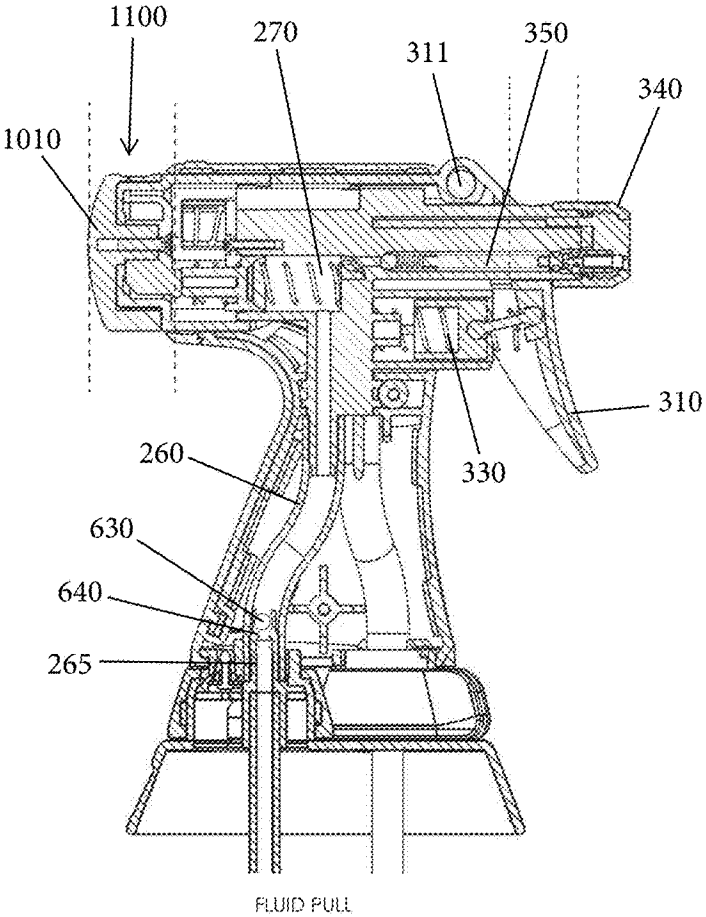
Figure 19:
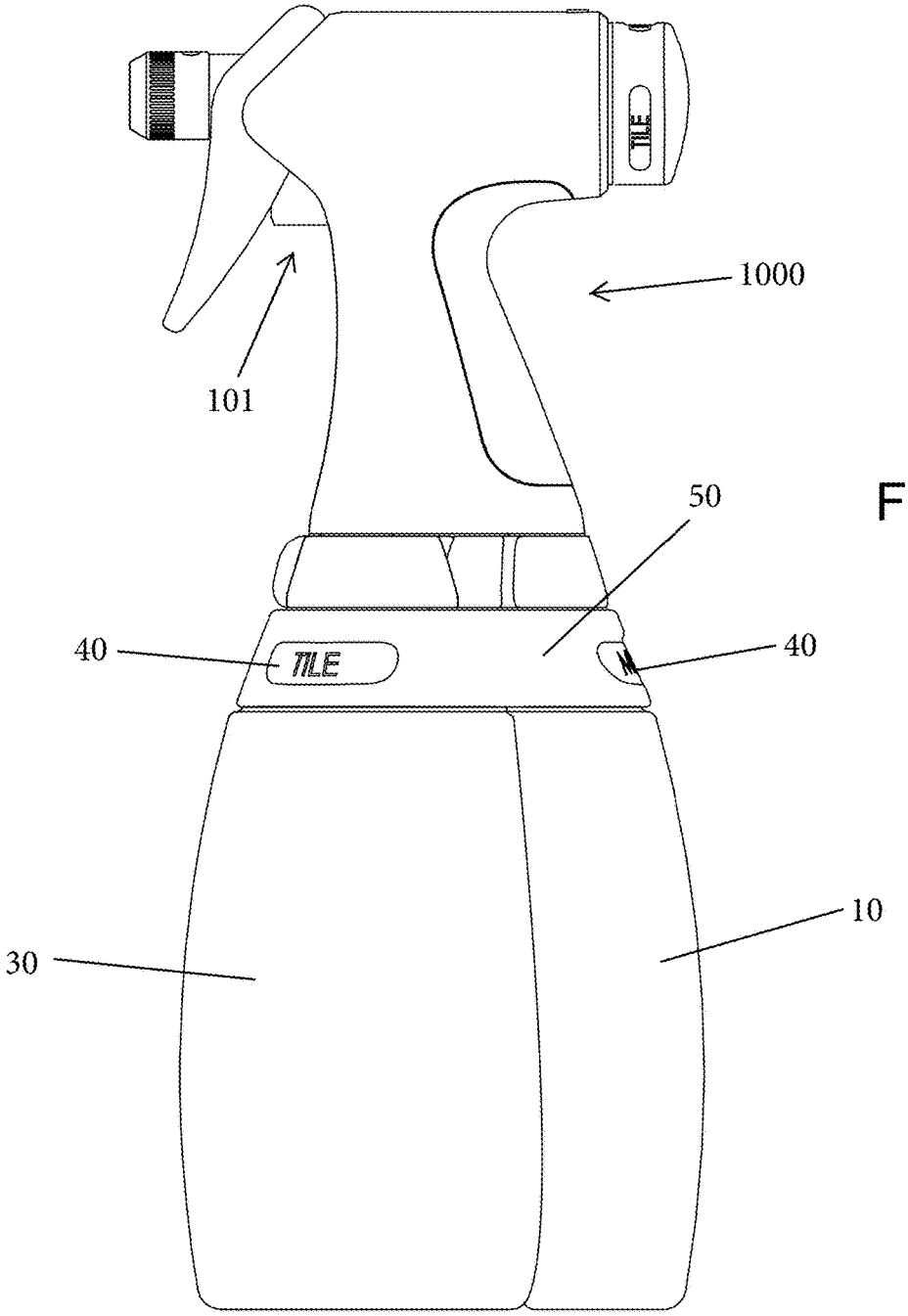
Figures 20A, 20B, 20C:
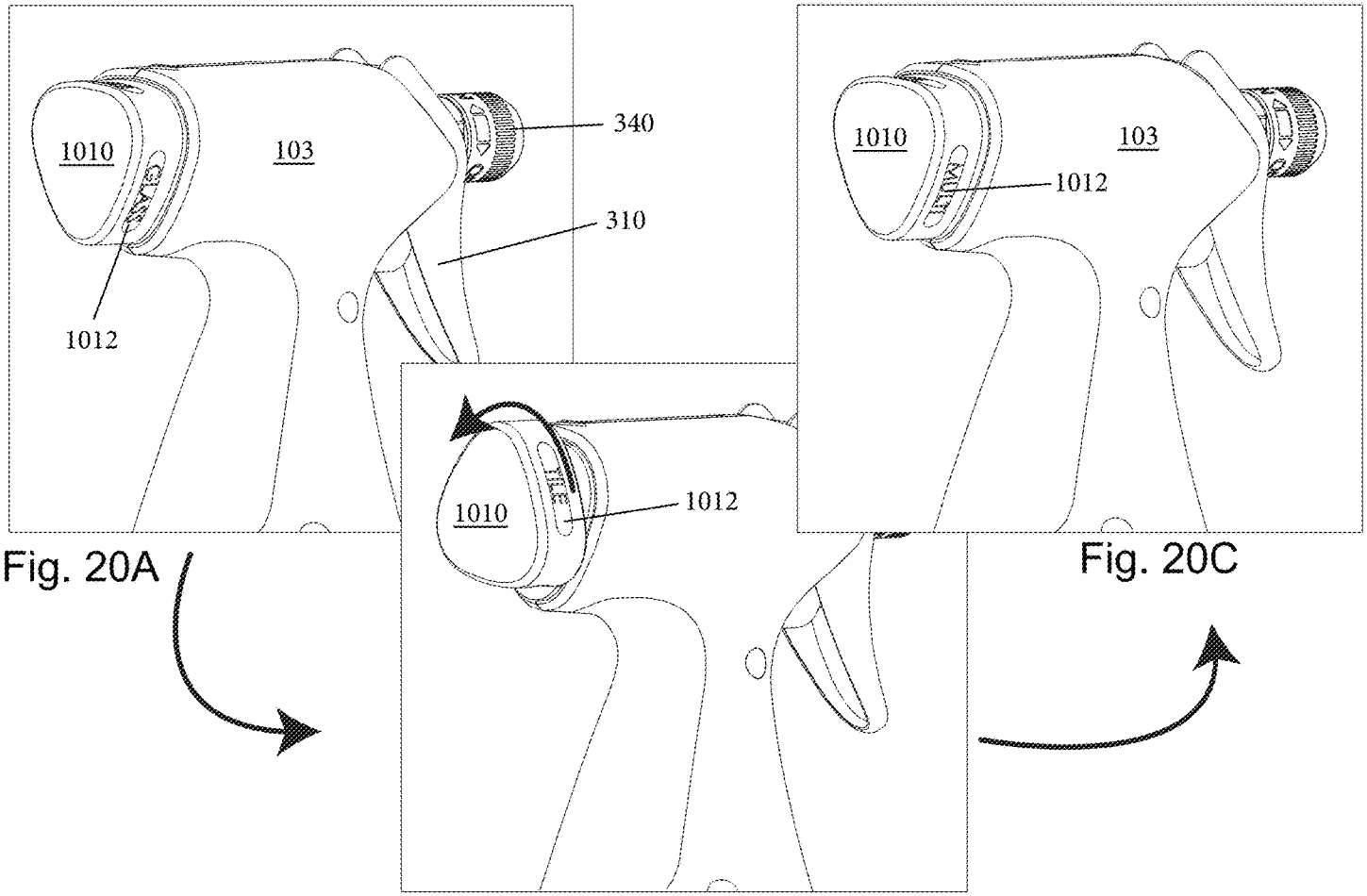
Figure 21:
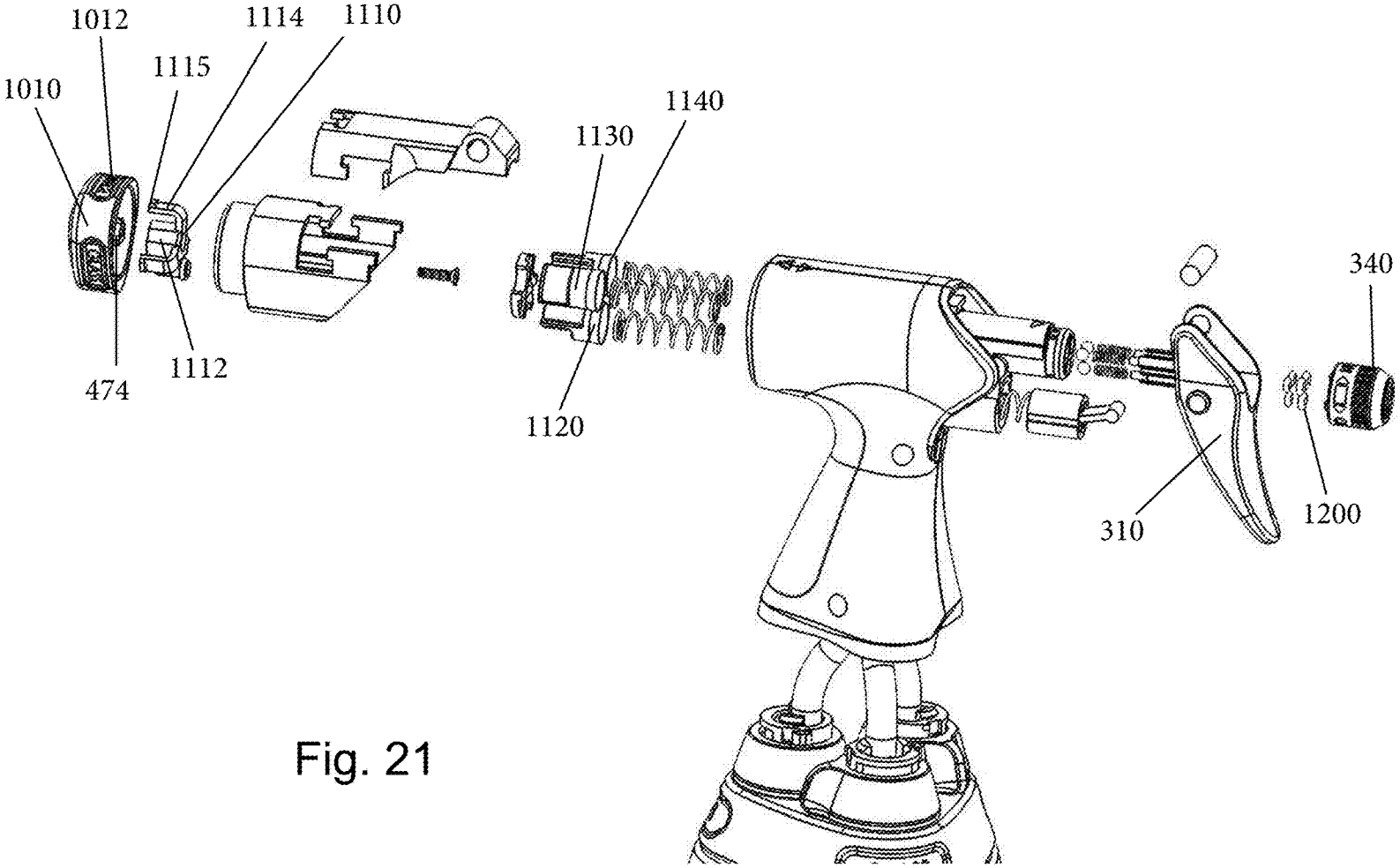
Figure 22:
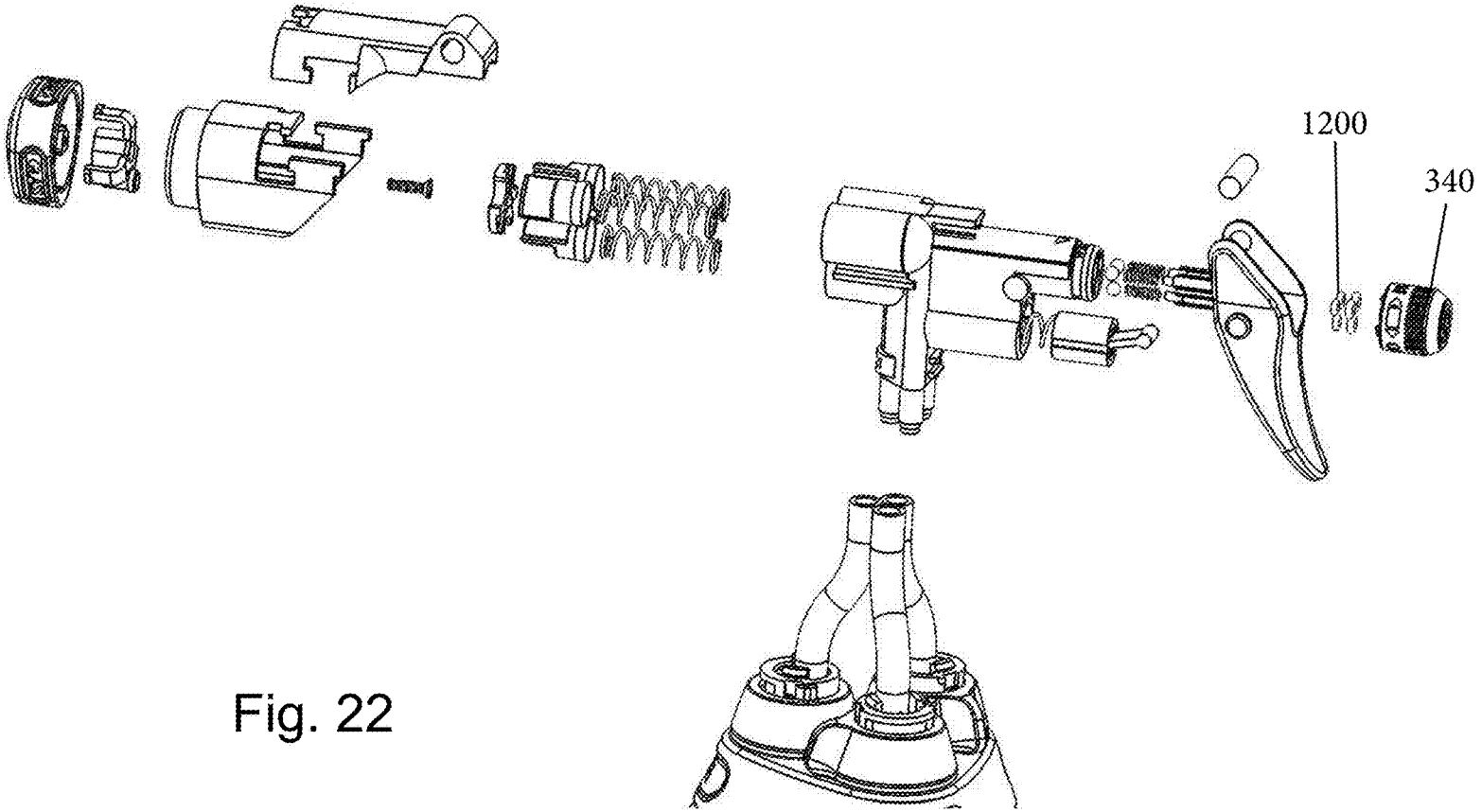
Figure 23:
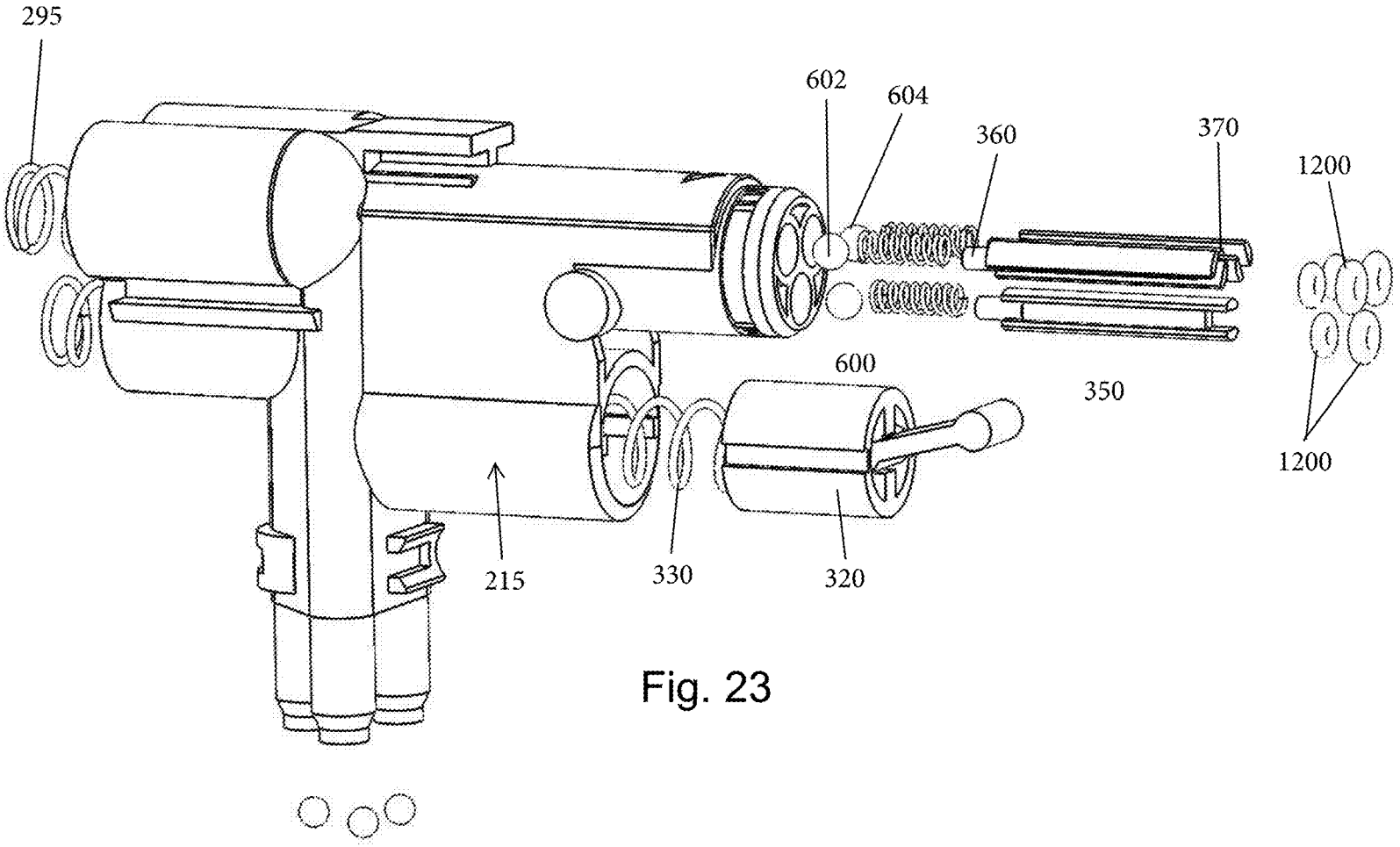
Figure 24:
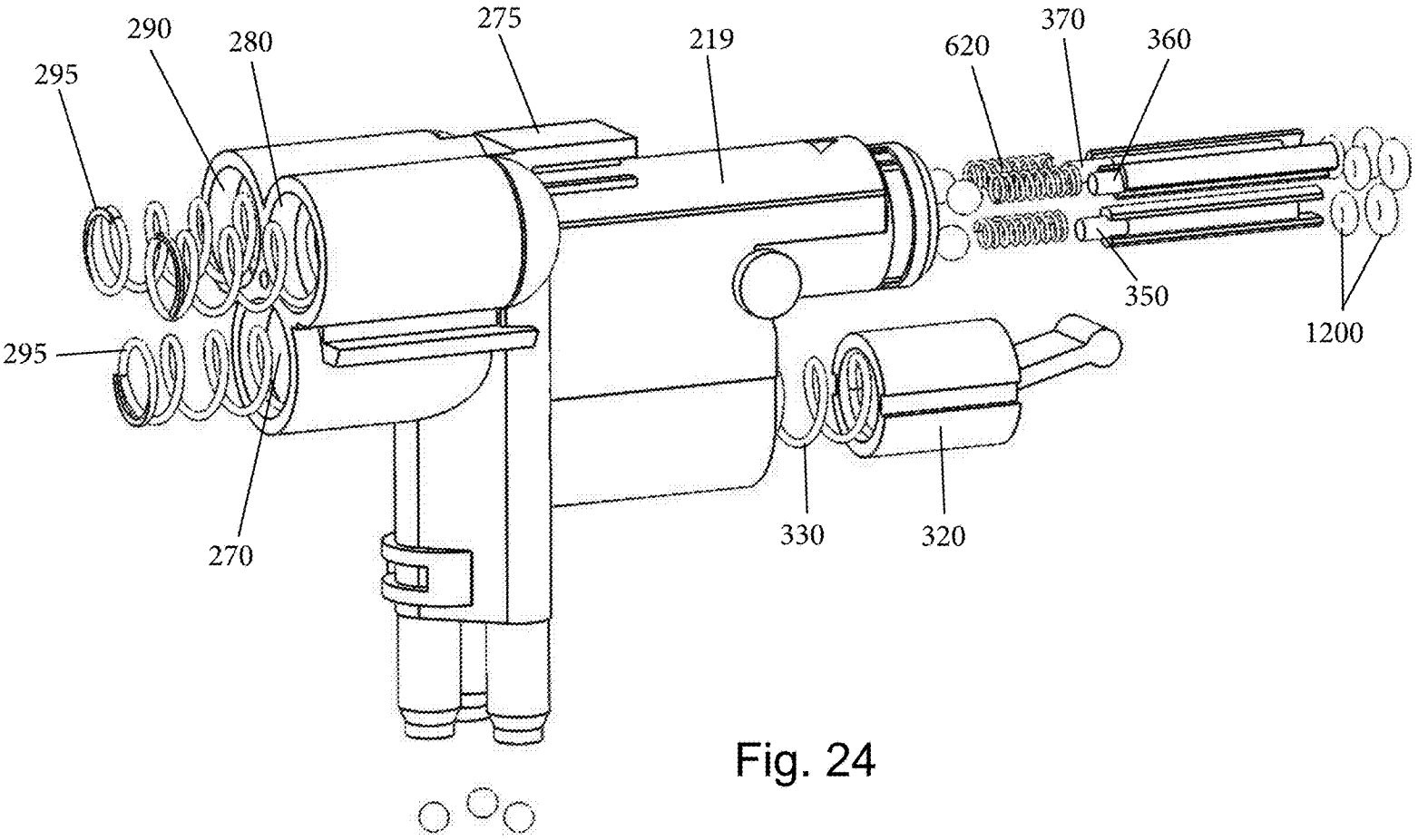
Figure 25:
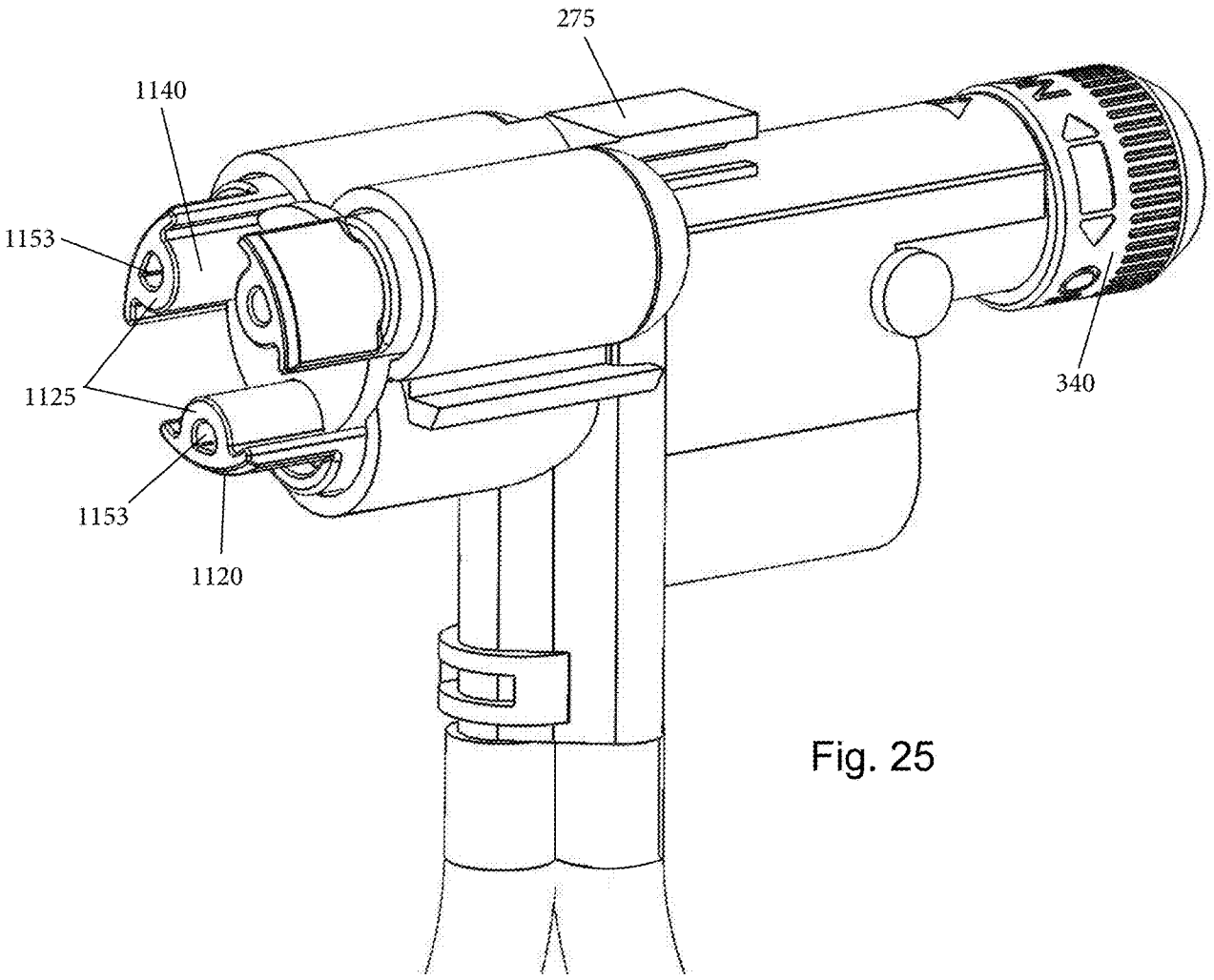
Figure 26:
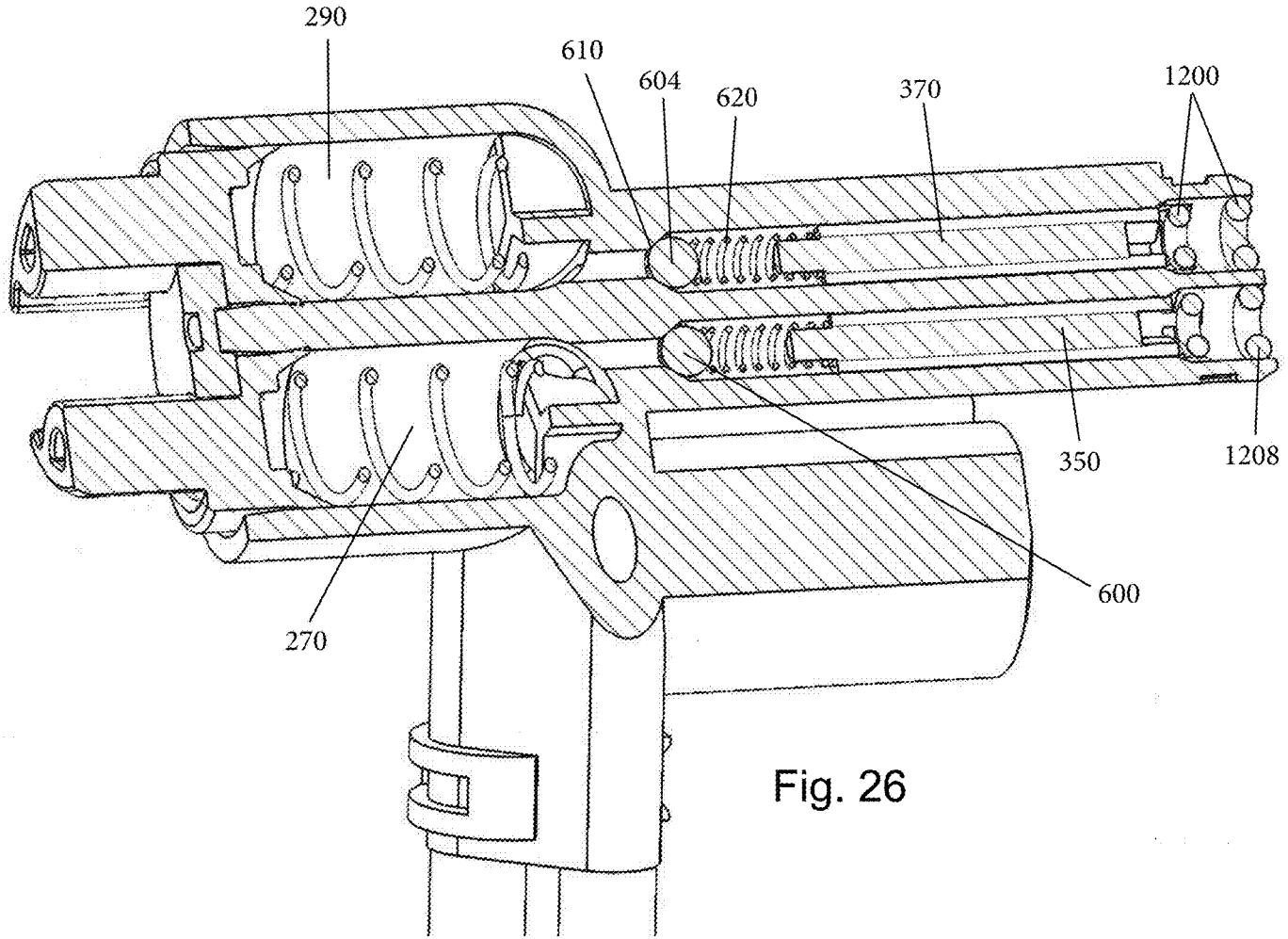
Figure 27:
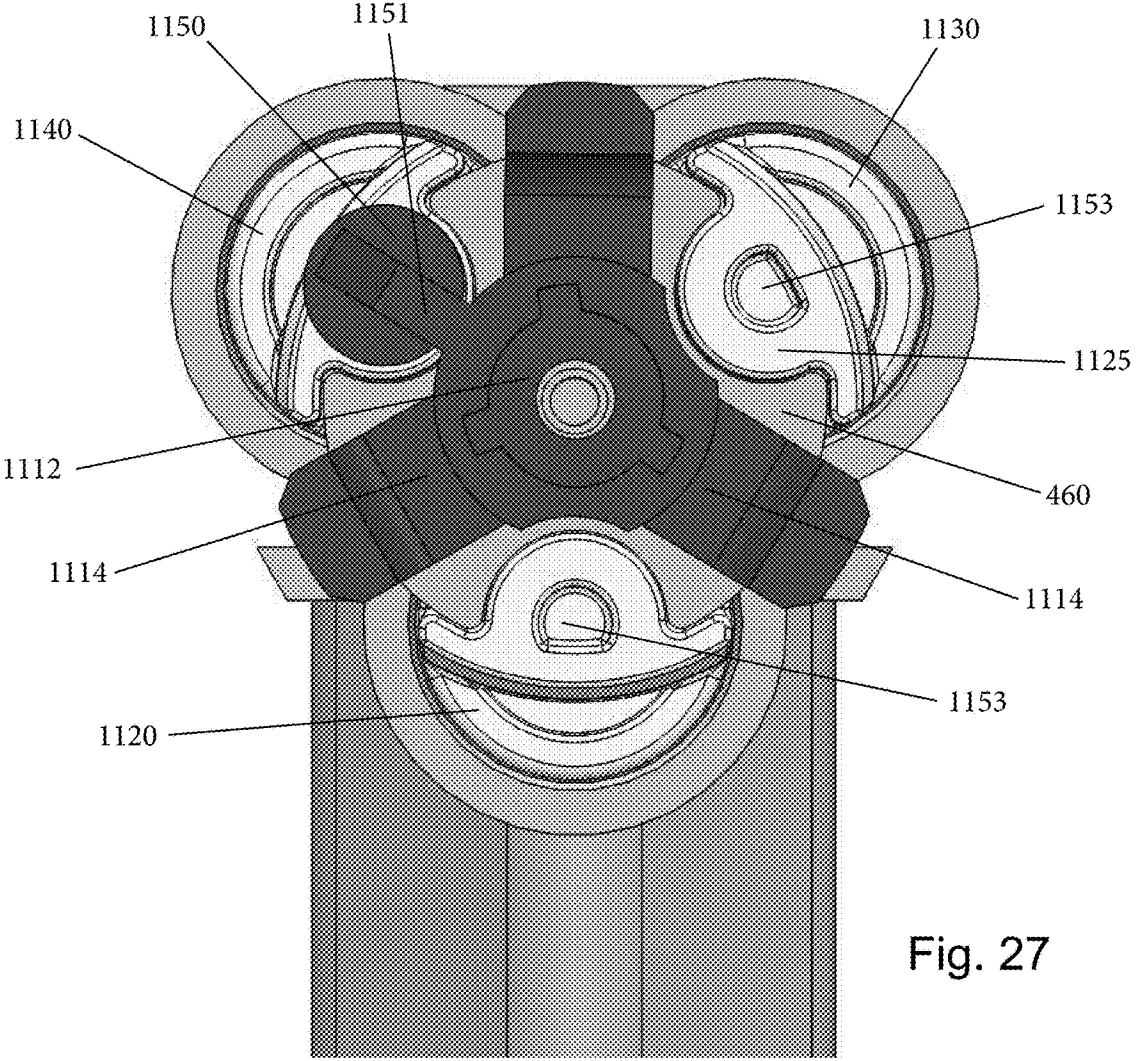
Figure 28B:
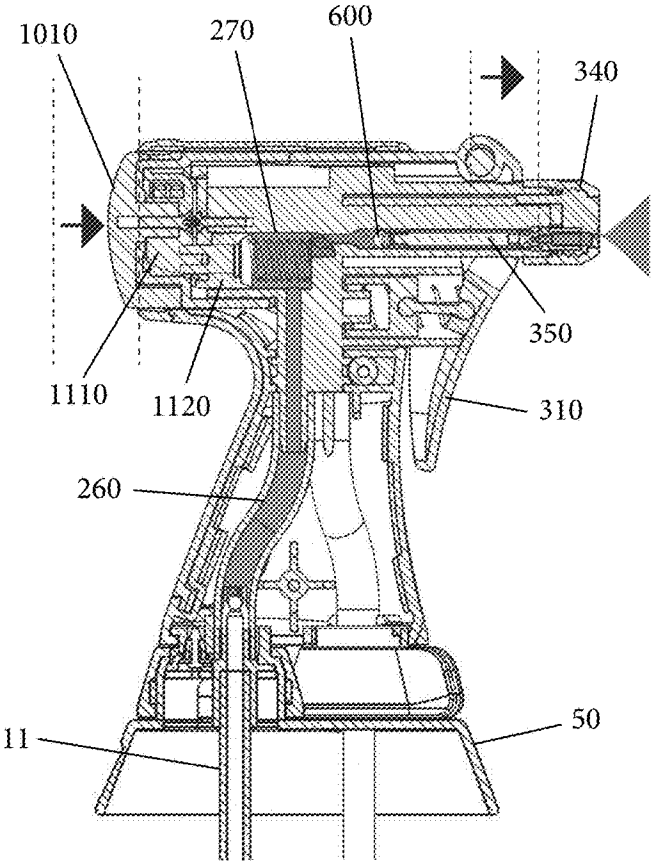
Figure 28A:
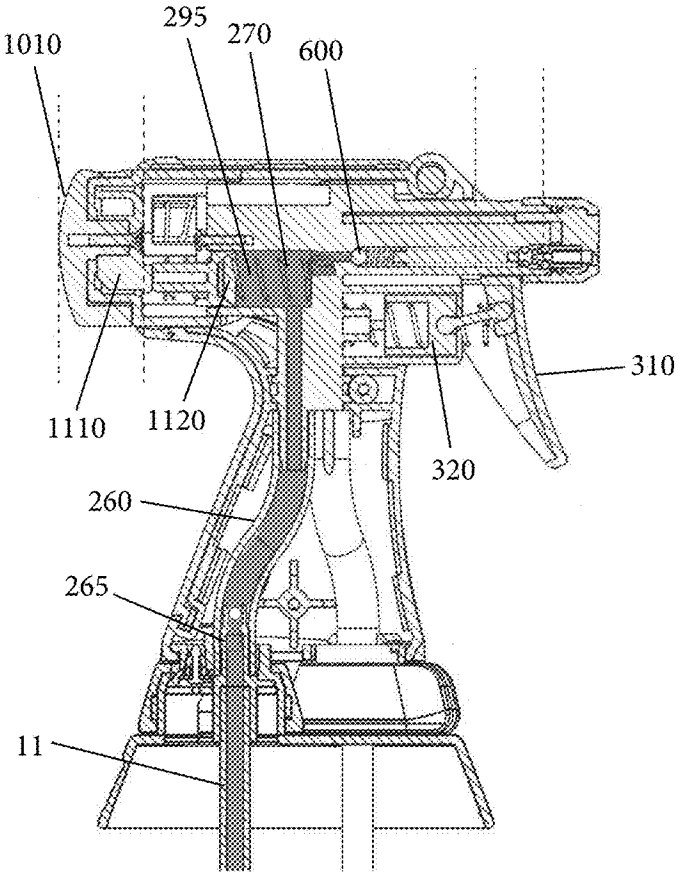
Figure 29:
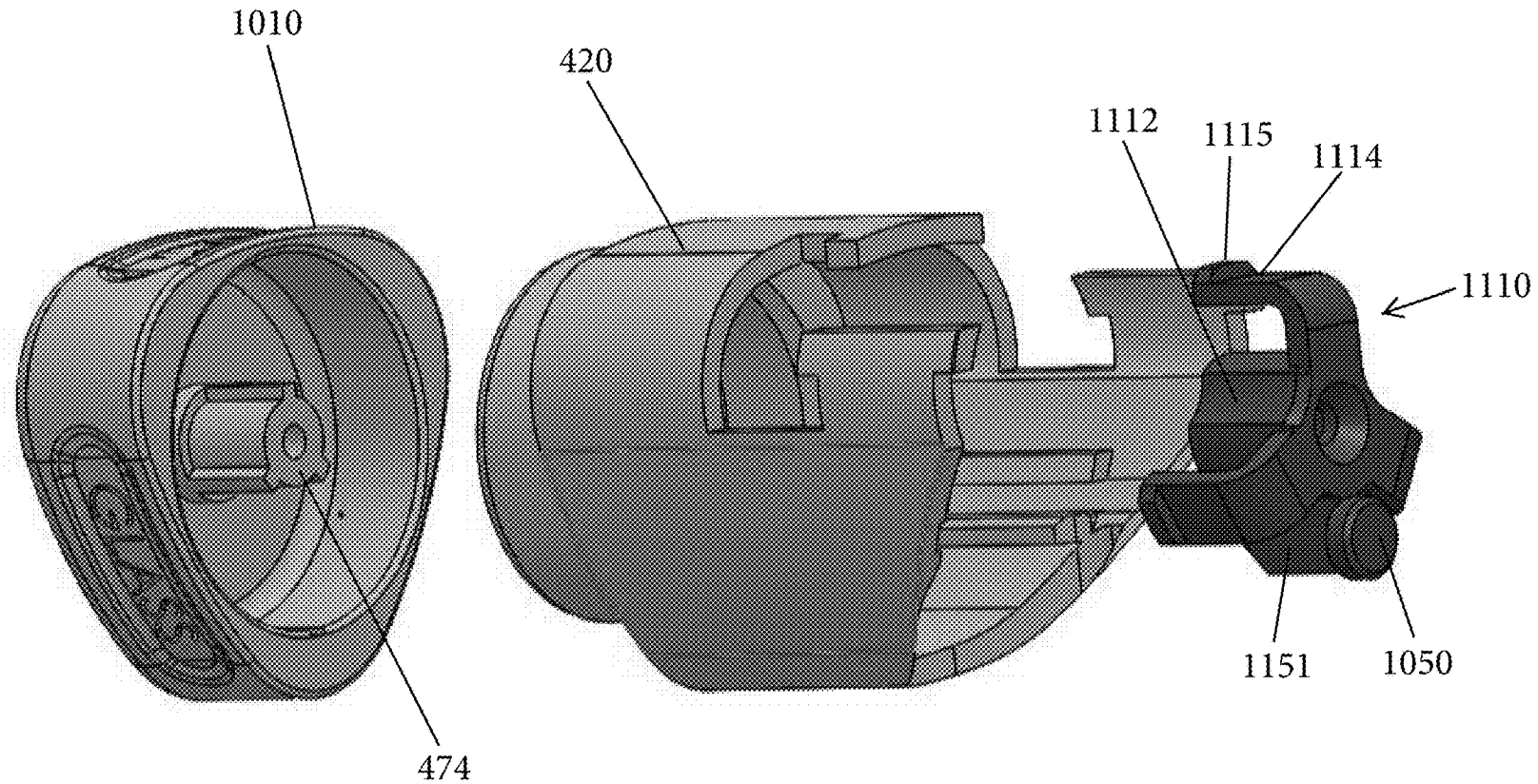

FIGS. 6A-C illustrate a selector knob (actuator) of the spray bottle head (trigger) and movement of the selector knob from a first selection (FIG. 6A) to a second selection (FIG. 6B) and then a third section (FIG. 6C);

FIG. 7 is an exploded perspective view of a spray bottle head including a pump assembly thereof;

FIG. 8 is an exploded perspective view of the spray bottle head with a handle cover not being shown;

FIG. 9 is an exploded side elevation view of the spray bottle head with the handle cover not being shown;

FIG. 10 is an exploded top plan view of the spray bottle head with the handle cover not being shown;

FIGS. 11A and 11B are cross-sectional view of the pump assembly showing a spraying action with FIG. 11A showing a fluid pull position and FIG. 11B showing a fluid push position;

FIGS. 12A and 12B are cross-sectional view of the pump assembly showing a spraying action fluid flow with FIG. 12A showing fluid flow during a fluid pull position and FIG. 12B showing fluid flow during a fluid push position;

FIG. 13 is a cross-sectional perspective view of the pump assembly;

FIG. 14 is a perspective view of a plurality of plungers that are part of the pump assembly;

FIG. 15 is a cross-sectional view of the plungers and corresponding portion of the pump assembly;

FIG. 16 is a first exploded perspective view of the pump assembly and plungers thereof;

FIG. 17 is a first exploded perspective view of the pump assembly and plungers thereof;

FIGS. 18A and 18B are cross-sectional views of an alternative pump assembly showing a spraying action fluid flow with FIG. 18A showing fluid flow during a fluid pull position and FIG. 18B showing fluid flow during a fluid push position;

FIG. 19 is a side elevation view of a multi-reservoir dispenser (e.g., spray bottle) in accordance with another embodiment of the present invention;

FIGS. 20A-C illustrate a selector knob (actuator) of the spray bottle head (trigger) and movement of the selector knob from a first selection (FIG. 6A) to a second selection (FIG. 6C);

FIG. 21 is an exploded perspective view of a pump assembly according to another embodiment;

FIG. 22 is an exploded perspective view of a pump assembly of FIG. 21 without the handle cover;

FIG. 23 is an exploded perspective view of the pump and plungers of the pump assembly;

FIG. 24 is another exploded perspective view of the pump and plungers of the pump assembly;

FIG. 25 is a perspective view of the partially assembled pump assembly;

FIG. 26 is a cross-sectional partial view of the pump assembly;

FIG. 27 is a cross-sectional view of the plunger engaging member engaged with one of the plungers;

FIGS. 28A and 28B are cross-sectional view of the pump assembly showing a spraying action fluid flow with FIG. 28A showing fluid flow during a fluid pull position and FIG. 28B showing fluid flow during a fluid push position; and FIG. 29 is a perspective view of a plunger engaging member according to a second embodiment.

DETAILED DESCRIPTION OF CERTAIN EMBODIMENTS

FIGS. 1-18B illustrate a multi-reservoir dispenser 100 in accordance with one embodiment of the present invention. The illustrated dispenser 100 is in the form of a spray-bottle that includes a plurality of reservoirs. For example, the dispenser 100 is configured to include two or more reservoirs and in the illustrated embodiment, the dispenser 100 includes three reservoirs, namely, a first reservoir 10, a second reservoir 20, and a third reservoir 30. Each of the first reservoir 10, second reservoir 20, and third reservoir 30 is in the form of a receptacle (e.g., bottle or container) that receives and holds one fluid. Each of the first reservoir 10, second reservoir 20, and third reservoir 30 can include identification indicia, generally shown at 40, that identifies and differentiates one reservoir from the other. For example, the identification indicia 40 can be in the form of one or more words (e.g., glass, tile, etc.) or numbers (e.g., 1, 2, and 3) that identify each reservoir.

In the illustrated embodiment, the multi-reservoir construction has a generally cylindrical shape and therefore, each of the reservoirs 10, 20, 30 is generally wedge shaped and the three reservoirs 10, 20, 30 fit together so as to define a cylindrical shape. The reservoirs 10, 20, 30 are typically made of plastic and have a closed bottom and an open top. As shown in FIG. 13, the open top end of each reservoir 10, 20, 30 can have a stepped construction defined by a first stepped portion 45 and a second stepped portion 47 that is above the first stepped portion 45. The top end of the second stepped portion 47 comprises the open end (neck) of the respective reservoir 10, 20, 30.

When three reservoirs 10, 20, 30 are used, it will be appreciated that each reservoir 10, 20, 30 generally extends about 120 degrees. It will also be understood that only two reservoirs can be provided in which case each reservoir would extend 180 degrees and further, more than three reservoirs can be provided. In the event that four reservoirs are provided, each reservoir extends 90 degrees. While, the illustrated embodiment shows a cylindrically shaped complete reservoir assembly, it will be appreciated that the complete reservoir assembly can take other forms and shapes and is not limited to a cylindrically shaped reservoir assembly. For example, each of the reservoirs can be square shaped and when combined together with the other square shaped reservoirs form a cube shaped reservoir assembly. It will also be appreciated that the reservoirs do not have to be equally divided. For example, two of the reservoirs can be 100 degrees and the third reservoir can be 160 degrees.

In the illustrated embodiment, the reservoirs 10, 20, 30 are detachably and removably coupled to a retainer 50 that is configured to hold and maintain the reservoirs 10, 20, 30. The retainer 50 can be in the form of a cup shaped structure with the indicia 40 being provided along the outer surface of the cup shaped structure. Each of the indicia 40 is located adjacent a corresponding reservoir. As shown in FIG. 13, a portion of the retainer 50 is disposed within the first stepped portion 45.

Any number of different techniques can be used to couple the reservoirs 10, 20, 30 to the other portions of the dispenser 100 and more specifically, fasteners, such as latches, can be used or for some shaped reservoirs 10, 20, 30 a screw type arrangement can be provided. Each reservoir 10, 20, 30 must be capable of being easily removed from the dispenser to allow for filling up, cleaning, or swapping of the reservoir. As shown in FIG. 13, the retainer 50 has a planar portion 51 that includes a hole through which the top portion of the reservoir 10, 20, 30 extends through.

FIG. 13 shows a clamp structure 60 that clamps to the top end portion of the respective reservoir 10, 20, 30, thereby securely attaching the reservoir 10, 20, 30 to a spray bottle head assembly 101 that has a handle housing 103. The clamp structure 60 is configured such that when the clamp is in the open position, the top end portion of the respective reservoir is inserted into the clamp structure 60 and the clamp is then closed so as to grasp and hold the top end portion in place. Each reservoir 10, 20, 30 has its own independent clamp structure that operates independent from the others and therefore, one or more reservoirs 10, 20, 30 can be removed, while the others remain fixedly attached to the spray body head assembly 101.

As shown in the figures, the spray body head assembly 101 comprises a main body 200, a trigger mechanism 300, a selector 400, and a pump assembly.

The main body 200 is shown in FIGS. 1-6 and is in the form of a hollow housing that has first (upper) end 202 and an opposing second (lower) end 204 that is open for receiving various components as described herein.

As with traditional spray bottles, an upper portion 210 of the main body 200 is wider than a lower portion 212 of the main body 200, with the lower portion 212 being the portion that is grasped by the user during operation of the dispenser 100. As shown the rear of the upper portion 210 overhangs the rear of the lower portion 212 so as to define a structure in which the user places his/her hand with the thumb on one side of the lower portion 212 and the fingers on the other side of the lower portion 212 so that the fingers can contact and pull on the trigger mechanism 300. A rear of the lower portion 212 can include ribs 208 or other surface features to assist in the user grasping the main body 200 during use of the dispenser. Both the front and the rear of the upper portion 210 are open to receive certain components as described herein.

The trigger mechanism 300 includes a pivotable trigger 310 that is pivotally attached to the upper portion 210 of the main body 200. As shown, the trigger 310 can pivot about an axle (pin) 311. FIGS. 11A and 12A show the trigger 310 in a fluid position and FIGS. 11B and 12B show the trigger 310 in a fluid position. The trigger 310 is biased by a biasing mechanism which comprises a coupling part 320 which includes pins 322 for coupling one end of the coupling part 320 to the trigger 310 and at an opposite end of the coupling part 320, a biasing element, such as a spring 330, is attached. The other end of the spring 330 is attached to an inner housing 215 (FIG. 8) that is contained within the upper portion 210 of the main body 200. In the rest position of the trigger 310 (FIGS. 11A and 12A), the spring 330 is also in its rest position and conversely, when the trigger 310 is pulled toward the handle body 220, the spring 330 compresses and stores energy. When the trigger 310 is released, the spring 330 applies a biasing force to restore the trigger 310 to its extended rest position.

In order to assist grasping the trigger 310, a front surface of the trigger 310 can include tactile features, such as ribs 315. The trigger 310 also includes a slot 319 in which parts are disposed including a rotatable nozzle 340. As described herein, the nozzle 340 includes openings 341 with each opening being associated with one specific reservoir 10, 20, 30 to allow fluid held in the respective reservoir to be discharged therethrough.

The inner housing 215 includes several different parts including a first hollow portion 217 (which can resemble a tube) and a second hollow portion 219 which also can resemble a tube. The first hollow portion 217 receives the spring 330 and at least a portion of the coupling part 320. The second hollow portion 219 extends outward a further distance than the first hollow portion 217 and is located above the first hollow portion 217. The second hollow portion 219 can include one or more pins 221 that protrude outwardly therefrom and are configured for reception within a complementary hole 317 (FIG. 8) that is formed in the trigger 310 and also attaches to the handle housing 103 so as to fixedly attach the inner housing 215 to the handle housing 103. The reception of the pins 221 in the holes 317 thus serves to couple the trigger 310 to the inner housing 215 at a pivot (pin 221). A distal end of the second hollow portion 219 can include threads 223 which are configured to mate with inner threads that are formed inside of the nozzle 340. The nozzle can also include a locking feature.

As shown, the inner housing 215 can be thought of as a fluid manifold in that the fluid from each reservoir is independently routed through the inner housing 215 to the nozzle 340. As described herein, each reservoir 10, 20, 30 has its own defined flow path that is separated from the other flow paths. As such, the inner housing 215 has a number of parts that facilitate the independent fluid flow from each reservoir to the nozzle 340.

As best shown in FIGS. 11-13, the reservoir 10 includes a first conduit 11 which can be in the form of tube that extends internally within the reservoir and is the means by which the fluid contained in the reservoir 10 is drawn up to the pump assembly. Similarly, the reservoir 20 includes a first conduit which can be in the form of tube that extends internally within the reservoir and is the means by which the fluid contained in the reservoir 20 is drawn up to the pump assembly. This first conduit can thus be identical to the first conduit 11 with the exception that it is within reservoir 20. The reservoir 30 includes a first conduit which can be in the form of tube that extends internally within the reservoir and is the means by which the fluid contained in the reservoir 30 is drawn up to the pump assembly. This first conduit can thus be identical to the first conduit 11 with the exception that it is within reservoir 30.

The inner housing 215 includes a first set of conduits 250, 252, 254 that mate with main conduit connectors 260, 262, 264 that are in fluid communication with the reservoirs 10, 20, 30 and more specifically, are in fluid communication with the conduits 11, 21, 31, respectively. The conduits 250, 252, 254 can be in the form of tubes or conduits formed internally within the body of the inner housing 215 that extend downwardly and are spaced apart from one another. In other words, the conduits 250, 252, 254 can be oriented parallel to one another and formed generally as a bundle. The main conduit connectors 260, 262, 264 serve to fluidly connect the first set of conduits 250, 252, 254 to the conduits 11, 21, 31, respectively. The main conduit connectors 260, 262, 264 can thus in the form of tubular structures in which: a first end of the connector 260 fluidly connects to the conduit 250 and a second end of the connector 260 fluidly connects to the conduit 11; a first end of the connector 262 fluidly connects to the conduit 252 and a second end of the connector 262 fluidly connects to the conduit 21; and a first end of the connector 264 fluidly connects to the conduit 254 and a second end of the connector 264 fluidly connects to the conduit 31. As shown, the main conduit connectors 260, 262, 264 can be angled so as to allow bottom portions thereof to be received centrally within the necks of the reservoirs 10, 20, 30, while top portions of the main conduit members 260, 262, 264 can be in contact or in close proximity to one another. The top portions can be parallel to one another.

Friction fits or other types of coupling techniques can be used to attach the conduits 250, 252, 254 to the main conduit connectors 260, 262, 264 and similarly, to attach the main conduit connectors 260, 262, 264 to the conduits 11, 21, 31.

As shown in the figures, each reservoir 10, 20, 30 can have an upper fluid connector, in the form of a nipple, that serves to fluidly connect the removable spray head with the conduits 11, 21, 31 in the reservoirs. In particular, the first reservoir 10 has a first upper fluid connector 265 that mates with a bottom end of the main conduit member 260 and mates with a top end of the conduit 11. The first upper fluid connector 265 can pass through cap-like cover structure of the reservoir 10. Similarly, the second reservoir 20 has a second upper fluid connector (not shown) that mates with a bottom end of the main conduit member 262 and mates with a top end of the conduit 21 and the third reservoir 30 has a third upper fluid connector (not shown) that mates with a bottom end of the main conduit member 264 and mates with a top end of the conduit 31.

The inner housing 215 also includes a number of plunger receiving cavities that formed in a rear portion of the inner housing. In particular, for each reservoir, there is one dedicated plunger receiving cavity. In the case of the illustrated embodiment in which there are three reservoirs 10, 20, 30, the inner housing 215 includes a first plunger receiving cavity 270, a second plunger receiving cavity 280, and a third plunger receiving cavity 290. The shapes and sizes of the first plunger receiving cavity 270, the second plunger receiving cavity 280, and the third plunger receiving cavity 290 are selected in view of the construction of the plungers as described herein and more particularly, the plunger seals against the walls that define the plunger receiving cavity. A biasing member 295, in the form of a spring, is received within each of the first, second, and third plunger receiving cavities.

The second hollow portion 219 has discrete elongated hollow portions that are separated from one another and are spaced apart from one another. In the illustrated embodiment, the second hollow portion 219 includes three discrete hollow portions, each of which defines a distal flow path from one of the reservoirs 10, 20, 30 to the nozzle 340. The second hollow portion 219 contains dedicated elongated inserts that are inserted into the discrete elongated hollow portions so as to at least partially define distal fluid flow paths that direct fluid from the pump assembly to the nozzle 340. The elongated insert that is received within one elongated hollow portion occupies space therein so as to further define the distal flow path along which the fluid travels from one reservoir 10, 20, 30 to the nozzle 340.

In the illustrated embodiment, there are three elongated inserts, namely, a first elongated insert 350 that is received within one elongated hollow portion, a second elongated insert 360 that is received within one elongated hollow portion and a third elongated insert 370 that is received within one elongated hollow portion. The first, second, and third elongated inserts 350, 360, 370 can be in the form of elongated contoured shafts or rods that define in part the fluid flow path. The reception of the elongated insert within one respective elongated hollow portion serves to redefine the open shape of the hollow portion and in particular, serves to reduce the open area of the hollow portion. A proximal end of the elongated insert can be of reduced dimensions. The purpose of the elongated inserts 350, 360, 370 is to provide pressure to the spring (620) which holds the valve members (600, 602, 604) against the valve seat (610).

The second hollow portion 219 of the inner housing 215 includes discrete, independent flow paths from each of the reservoirs 10, 20, 30 to the nozzle 340. More particularly, the inner housing 215 can include a first flow path 390 that provides fluid communication between the first reservoir 10 and the nozzle 340; a second flow path 391 that provides fluid communication between the second reservoir 20 and the nozzle 340; and a third flow path 392 that provides fluid communication between the third reservoir 30 and the nozzle 340. As described herein, each of the fluid flow paths from one respective reservoir to the nozzle is sealed from the other fluid flow paths such that cross contamination between fluids from different reservoirs cannot occur. One of the prominent features of the present invention is that the flow (fluid) path from each reservoir to the nozzle 340 is isolated and separated from the others and therefore, there is no cross contamination between fluids.

As shown in FIG. 12B, the reduced width conduit is in fluid communication with one of the plunger receiving cavities. In particular, the first plunger receiving cavity 270 defines part of the first flow path 390 and is in fluid communication with the reduced width conduit that is part of the first flow path 390. As will be described herein, fluid that is drawn into the first plunger receiving cavity 270 is expelled by the plunger through the reduced width conduit to the nozzle 340. The reduced width conduit can thus define part of a fluid outlet from the first plunger receiving cavity 270. It will be appreciated that each of the second plunger receiving cavity 280 and the third plunger receiving cavity 290 has an identical type construction and arrangement such that each is in fluid communication with one reduced width conduit that defines an outlet flow path to the nozzle 340.

A plurality of first valve assemblies are provided within the inner housing 215 and in particular, can be disposed within the circular shaped second hollow portion 219 thereof. It will be appreciated that the first valve assemblies comprise a plurality of discrete valve members (valve assemblies) and more particularly, there is one dedicated valve member for each of the three distal conduits 350, 360, 370 so as to independently control the flow through each respective distal conduit 350, 360, 370. Thus, the first distal conduit 350 includes a first valve member 600, the second distal conduit 360 includes a second valve member 602, and the third distal conduit 370 includes a third valve member 604. Each valve member 600, 602, 604 is configured to seat against a valve seat 610 such that when the valve member 600, 602, 604 seats the valve seat 610, the flow path to the nozzle 340 is closed. As shown in FIG. 12B, the valve seat 610 marks a transition from a reduced width conduit portion to a larger width conduit portion, with the valve member 600, 602, 604 being disposed within the larger width conduit portion.

In the illustrated embodiment, each of the first valve member 600, the second valve member 602, and the third valve member 604 can be in the form of a ball.

Each of the first valve member 600, second valve member 602, and third valve member 604 is biased by a biasing member 620, such as a spring, that applies a force to the respective valve member. The biasing member 620 applies a biasing force to the valve member 600, 602, 604 in a proximal direction toward the valve seat 610. In the closed position, the ball valve member 600, 602, 604 is seated against the valve seat 610, thereby closing the reduced width conduit formed in the second hollow portion 219.

As shown in FIGS. 11A and 12A, when the valve member 600 is in the closed position, fluid is prevented from flowing to the nozzle 340, while in the opposite open position shown in FIGS. 11B and 12B, the fluid can flow around the ball valve member 600 and the corresponding elongated insert to the nozzle 340. The same operation is true for valve members 602, 604 which are not shown in these figures.

The inner housing 215 also includes a number of inlet conduits that each leads to a respective one of the first plunger receiving cavity 270, the second plunger receiving cavity 280 and the third plunger receiving cavity 290. More specifically, each of the conduits 250, 252, 254 is in fluid communication with one of the plunger receiving cavities 270, 280, 290 and serves as an inlet conduit for delivering fluid from one of the reservoirs 10, 20, 30 to the corresponding one of the plunger receiving cavities 270, 280, 290 upon application of negative pressure (suction) as described herein.

As previously mentioned, the conduits 250, 252, 254 mate with the main conduit connectors 260, 262, 264 so as to define the various flow paths 390, 391, 392 from the reservoirs 10, 20, 30 to the nozzle 340. The connection between each of the main conduit connectors 260, 262, 264 and one corresponding conduit 250, 252, 254 thus completes and establishes the discrete flow path that allows fluid from one reservoir 10, 20, 30 to flow to the nozzle 340 without comingling with any other fluid from a different reservoir due to the dedicated, independent plumbing construction of the present invention.

It will therefore be appreciated that each of the first valve assemblies (valve members 600, 602, 604) is thus located downstream of one of the plunger receiving cavities.

A plurality of second valve assemblies is provided, each of which is located upstream of one respective plunger receiving cavity. It will be appreciated that the second valve assemblies comprise a plurality of discrete valve members and more particularly, there is one dedicated valve member for each of the three distal conduits 350, 360, 370 so as to independently control the flow through each respective distal conduit 350, 360, 370.

Each of the second valve assemblies is disposed between one conduit 250, 252, 254 and the corresponding main conduit connector 260, 262, 264 that is fluidly connected thereto. In the illustrated embodiment, there are three second valve assemblies, namely, a fourth valve member 630, a fifth valve member 632, and a sixth valve member 634. The fourth valve member 630 along with the first valve member 600 are located along the first flow path 390, the fifth valve member 632 along with the second valve member 602 are located along the second flow path 391, and the sixth valve member 634 along with the third valve member 604 are located along the third flow path 392.

Each valve member 630, 632, 634 is configured to seat against a valve seat 640 such that when the valve member seats the valve seat 640, the flow path to the respective plunger receiving cavities 270, 280, 290 is closed. Each of the main conduit connectors 260, 262, 264 includes a valve seat 640 that is formed internally therein. In an alternative design shown in FIGS. 18A and 18B, the valve seat 640 can be formed instead in the upper fluid connector 265. As shown in FIGS. 11A and 11B, the valve seat 640 marks a transition from a reduced width conduit to a larger width conduit, with the valve member being disposed within the larger width conduit.

In the illustrated embodiment, each of the fourth valve member 630, the fifth valve member 632, and the sixth valve member 634 can be in the form of a ball. As shown in FIGS. 11B and 12B, when the valve member 630, 632, 634 is in the closed position, fluid from each of the reservoirs 10, 20, 30 is prevented from being drawn into the respective plunger receiving cavities 270, 280, 290. In other words, each valve member 630, 632, 634 prevents fluid to flow into one of the respective conduits 250, 252, 254 formed in the inner housing 215. In this way, fluid is prevented from flowing back to the respective reservoir 10, 20, 30.

It will therefore be appreciated that each of the second valve assemblies (valve members 630, 632, 634) is thus located upstream of one of the plunger receiving cavities.

As shown in FIGS. 11A-B and 12A-B, the operating states of the first valve assemblies and the second valve assemblies are directly opposite one another during the fluid pull step (FIGS. 11A and 12A) and the fluid push step (FIGS. 11B and 12B). As shown during the fluid pull step involving the first reservoir 10 and flow along the first fluid path 390, the valve member 600 is in the closed position, while the valve member 630 is in the open position which allows fluid from the first reservoir 10 to be drawn into the first plunger receiving cavity 270. Conversely, during the fluid push step involving the first reservoir 10 and flow along the first fluid path 390, the valve member 600 is in the open position, while the valve member 630 is in the closed position which closes off the reservoir 10 from the first plunger receiving cavity 270 and allows fluid to flow (be discharged) from the first plunger receiving cavity 270 to the nozzle 340 where it exits. As shown in FIG. 16, at the top of the inner housing 215 is a track body 275 having opposing tracks 277 formed on each side of the track body 275.

As shown in FIGS. 8, 9 and 13, the selector 400 is part of an assembly that includes the selector parts that cooperate with the inner housing 215 and the trigger 300. These figures do not include the handle housing. The selector 400 includes a first housing part 410 and a second housing part 420 that mate together to form a hollow shell-like structure that surrounds the inner housing 215 and is coupled to both the inner housing 215 and the trigger 300. The first housing part 410 can be thought of as being a top portion and the second housing part 420 can be thought of as being a bottom portion. Any number of different techniques can be used to attach the first and second housing parts 410, 420 including use a snap fit arrangement. A front end 412 of the first housing part 410 includes a cross bore 411 that receives the axle 311 of the trigger 300. The second housing part 420 has a plurality of openings or slots 425 the function of which is described below.

The selector housing is thus coupled to the trigger 300 such that movement of the trigger 300 is directly translated into movement of a portion of the selector assembly and in particular, the selector housing/assembly moves relative to the inner housing 215.

The selector assembly 400 also includes a plurality of movable plungers which are configured to be received within the plunger receiving cavity. There is therefore, one plunger for each corresponding plunger receiving cavity. In the illustrated embodiment, there are three plungers, namely a first plunger 430 that is received within the first plunger receiving cavity 270, a second plunger 440 that is received within the second plunger receiving cavity 280, and a third plunger 450 that is received within the third plunger receiving cavity 290. As in the figures (such as FIGS. 9 and 14), each of the first, second and third plungers 430, 440, 450 can have a stepped construction in that the front end of the plunger has a greater dimension (diameter) that the rear end and is configured to seal against the side wall of the plunger receiving cavity. It will be understood that the forward movement of the plunger within a corresponding plunger receiving cavity that contains fluid results in the plunger expelling the fluid therefrom. As shown in FIG. 14, the rear end of the plunger can have an arcuate shaped portion 435. A retainer 460 (FIG. 14) can be provided to maintain the plungers 430, 440, 450 in place while permitting sliding axial movement thereof. The retainer 460 thus has a series of (arcuate shaped) notches formed therein to accommodate the arcuate shape portions 435.

The selector assembly 400 includes a rotatable selector that is accessible to and manipulated by the user to select which reservoir 10, 20, 30 from which the fluid is drawn from. The rotatable selector includes an outer selector part 470, a locking member 480, and a plunger engaging member (inner part) 490 that are all coupled together to form the assembled rotatable selector.

The outer selector part 470 is a hollow part that has an outer wall 472 and a side wall 473 that extends around a periphery of the outer wall 472 and defines a hollow interior. Within the hollow interior is a boss 474 that is integral to the inner face of the outer wall 472 and extends outwardly therefrom. The boss 474 includes a center bore to receive a fastener for attaching the plunger engaging member 490 to the outer selector part 470. The outer wall 472 includes a through hole 475 (FIGS. 6A-C).

The locking member 480 includes an outer wall 482 and a plurality of (flexible) fingers 484 that are integral to and extend outwardly from the outer wall 482. At the end of each finger 484 is a locking tab 485 which can be in the form of a beveled protrusion (cam member). The illustrated locking member 480 includes three fingers 484. The locking tabs 485 are received within the openings 425 to secure the selector assembly to the second housing part 420. The flexing of the fingers 484 permits the locking tabs 485 to ride into the openings 425 to secure the attachment between the respective parts. The locking member 480 is thus fixedly attached to the selector housing and does not rotate when the outer selector part 470 and the plunger engaging member 490 rotate in unison. An outer surface of the outer wall 482 includes indicia that identifies each reservoir 10, 20, 30. As illustrated, the indicia can be in the form of the number 1 for the first reservoir 10, the number 2 for the second reservoir 20, and the number 3 for the third reservoir 30. However, it will be understood that other types of indicia can be used, such as letters or words, or graphics.

As mentioned, the plunger engaging member (inner part) 490 is directly attached to the outer selector part 470 and therefore, rotates therewith and is designed to selectively engage one of the first, second and third plungers 430, 440, 450. As shown in the figures, the plunger engaging member 490 includes an inner hub 492 to which a plurality of fingers 494 are attached. The fingers 494 are cantilevered structures that each has a free end at which a catch 495 is formed. The catches 495 are configured to be disposed within an inner track formed along an inner face of the outer wall 482 of the locking member 480. The reception of the catches 495 within the track provides a means by which the plunger engaging member 490 is coupled to the locking member 480, while still being capable of rotating relative thereto since the locking member 480 constitutes a fixed part.

A portion of the forward face of the plunger engaging member 490 includes a protrusion 499 that is configured to selectively engage one of the plungers 430, 440, 450, thereby placing said plunger in an active, engaged state which results in the plunger being pushed forward into the respective plunger receiving cavity when the selector assembly is pulled forward within the handle housing 103 and relative to the inner housing 215 due to action of the trigger 300. The protrusion 499 can be in the form of a rail that extends along the outer surface of the inner hub 492 between two fingers 494 (See, FIG. 9). For example, the protrusion 499 can be a linear rail that thus forms a protrusion that extends radially outward from the inner hub 492 but also extend longitudinally along the inner hub 492. When the selector assumes one of the selected positions, the protrusion (rail) 499 is aligned within one of the arcuate shaped portions 435 of the plungers. Due to its construction, forward advancement of the plunger engaging member 490 results in the inner hub 492 being driven into the space between the plungers 430, 440, 450; however, the protrusion 499 engages the selected one of the plungers 430, 440, 450 and therefore, continued forward advancement of the plunger engaging member 490 results in forward advancement of the engaged plunger within the respective plunger receiving cavity. It will be understood that rotation of the selector causes rotation of the protrusion 499 thereby resulting in a different plunger 430, 440, 450 being engaged and therefore activation of a pumping mechanism for a different reservoir.

Rotation of the coupled outer selector part 470 and the plunger engaging member 490 allows the selection of one of the reservoirs 10, 20, 30 to be placed in fluid communication with the pump mechanism. More particularly, one of the plungers 430, 440, 450 is rendered active and engaged by rotation and then selection of the coupled outer selector part 470 and the plunger engaging member 490.

The selection of the reservoir is apparent and indicated to the user by the indicia on the outer wall 482 and in particular, the indicia is located at set locations of the outer wall 482 such that rotation of the selector part causes registration between through hole 475 and the indicia (See, FIGS. 6A-C). For example, when the rotatable selector part (i.e., the coupled outer selector part 470 and the plunger engaging member 490) is in registration with the indicia (e.g., the number 1) associated with the first reservoir 10, this means that the first reservoir 10 is active and connected to the pumping mechanism and therefore, pulling the trigger 300 inward causes forward movement of the plunger 430 within the plunger receiving cavity 270 to expel fluid along the first fluid flow path and out of the nozzle 340. Similarly, when the rotatable selector part is in registration with the indicia (e.g., the number 2) associated with the second reservoir 20, this means that the second reservoir 20 is active and connected to the pumping mechanism and therefore, pulling the trigger 300 inward causes forward movement of the plunger 440 within the plunger receiving cavity 280 to expel fluid along the first fluid flow path and out of the nozzle 340. Similarly, when the rotatable selector part is in registration with the indicia (e.g., the number 3) associated with the third reservoir 30, this means that the third reservoir 30 is active and connected to the pumping mechanism and therefore, pulling the trigger 300 inward causes forward movement of the plunger 450 within the plunger receiving cavity 290 to expel fluid along the first fluid flow path and out of the nozzle 340.

As shown in FIGS. 6A-C, the user first selects the reservoir that is intended to be active for pumping. This again entails rotation of the outer selector part 470 until it assumes the proper position which is guided by the indicia on locking member 480.

As shown in FIGS. 11A, 11B, 12A, and 12B, operation of the trigger 300 serves to draw fluid and then expel this fluid through the nozzle.

In this matter, the selector assembly 400 is configured to only engage one reservoir at a time to perform the pumping operation. Since as described herein, the entire fluid flow path from the reservoir to the nozzle is maintained independent and spatially separated from the other fluid flow paths and therefore cross-contamination does not occur. This allows the reservoirs to be filled with liquids that are much different from one another. For example, in one configuration intended for housing cleaning, one reservoir can be filled with glass cleaner, one can be filled with bleach, and the other can be filled with an all-purpose cleaner. For car cleaning chores, one reservoir can be filled with glass cleaner, one can be filled with interior cleaner and one can be filled with paint wax. The combination of liquids is vast and safe given the construction of the dispenser of the present invention. Unlike conventional multi-reservoir dispensers, the nozzle 340 itself maintains separation of the fluid flow paths from the various reservoirs and at no time from flowing from the reservoir to the pump mechanism and then be pumped to and through the nozzle does the fluid come into contact with fluid from any of the other reservoirs.

It will also be appreciated that in contrast to prior art multi-reservoir dispensers that use two or more pump mechanisms, the present invention includes a common pump mechanism that is configured so as to be selected in different configurable states so as to activate the pumping of one reservoir, while the other reservoir or reservoirs are placed in an off-line state. The plunger engaging mechanism is only configured to engage one plunger at a given time and therefore, it is not possible to have multiple plungers activated at the same time resulting in a comingled fluid spray.

It will also be understood, as previously mentioned, that the dispenser can contain 2, 3 or 4 or more reservoirs with each having discrete pumping architecture.

In addition, it will be appreciated that while, the dispenser is described as being a dispenser for discharging liquids, the teachings of the present invention can be implemented in other dispenser applications such as dispenser of other liquids or even creams, etc. For example, a hand soap dispenser can be produced having reservoirs holding different soaps or even hand creams, or even a combination of soaps and creams.

FIGS. 19-28B illustrate a multi-reservoir dispenser 1000 in accordance with another embodiment of the present invention. The illustrated dispenser 1000 is also in the form of a spray-bottle that includes a plurality of reservoirs. The dispenser 1000 is similar to the dispenser 100 and therefore contains a number of the same parts that are contained in the dispenser 100. As a result, like elements are numbered alike and the discussion of FIGS. 19-28B focuses on the main differences between the dispenser 1000 and the dispenser 100.

As shown in FIG. 19, the indicia 40 can be in the form of text that identifies each of the reservoirs 10, 20, 30. For example, the text 40 can identify the reservoir by the name of the fluid to be contained therein, such as glass, tile, multi, etc. As described below, indicia that identifies each reservoir is now part of the outer selector part (on its rear face), always seen from behind. This means the through hole 475 is eliminated and indication of which reservoir is active is achieved with arrows molded into the top (upper end 202) of main body 200 that align with the corresponding indicia on the outer selector part).

FIGS. 19-20B also illustrates an alternative outer selector part 1010 which has the same construction as the outer selector part 470 with the exception that the outer wall 472 includes indicia 1012 that corresponds to and identifies one of the reservoirs 10, 20, 30. In particular, the indicia 1012 can correspond to the indicia 40. The indicia 1012 thus provides an easy way for the user to select and activate one of the reservoirs 10, 20, 30 for spray action. As the outer selector part 1010 rotates, the fixed indicia 1012 rotates and thus, the user can rotate the outer selector part 1010 until it is in a desired position indicating that the desired reservoir 10, 20, 30 is activated. FIGS. 20A-C show rotation of the outer selector part 1010 to select one of the three reservoirs 10, 20, 30.

The multi-reservoir dispenser 1000 includes a selector assembly 1100 that is similar to the selector assembly 400 and includes a rotatable selector that is accessible to and manipulated by the user to select which reservoir 10, 20, 30 from which the fluid is drawn from. The rotatable selector includes the outer selector part 1010 and a plunger engaging member (inner part) 1110 that are all coupled together to form the assembled rotatable selector.

Within the hollow interior of the outer selector part 1010 is a boss 474 that is integral to the inner face of the outer wall 472 and extends outwardly therefrom. The boss 474 includes a center bore to receive a fastener for attaching a plunger engaging member 1110 to the outer selector part 1010.

As mentioned, the plunger engaging member (inner part) 1110 is directly attached to the outer selector part 1010 and therefore, rotates therewith and is designed to selectively engage one of the first, second and third plungers 1120, 1130, 1140. The first, second and third plungers 1120, 1130, 1140 are very similar to the first, second and third plungers 430, 440, 450 as will be appreciated by the following description. More specifically, the rear end of the plunger can have an arcuate shaped portion 1125.

As shown in the figures, the plunger engaging member 1110 includes an inner hub 1112 to which a plurality of fingers 1114 are attached. The fingers 1114 are cantilevered structures that each has a free end at which a catch 1115 is formed. The catches 1115 are configured to be disposed within an inner track or inner recesses formed along an inner face of the outer selector part 1010. The reception of the catches 1115 within the track provides a further means by which the plunger engaging member 1110 is fixedly coupled to the outer selector part 1010 and since the outer selector part 1010 rotates, the rotation of the outer selector part 1010 is directly translated into rotation of the plunger engaging member 1110. As also shown, a fastener, such as a screw, can be used to fixedly attach the plunger engaging member 1110 to the outer selector part 1010.

The plunger engaging member 1110 includes a protrusion 1150 that is configured to selectively engage one of the plungers 1120, 1130, 1140, thereby placing said plunger in an active, engaged state which results in the plunger being pushed forward into the respective plunger receiving cavity when the selector assembly is pulled forward within the handle housing 210 and relative to the inner housing thereof due to action of the trigger 300. The protrusion 1150 can be in the form of a disk that extends along the outer surface of the inner hub 1112 between two fingers 1114 (See, FIGS. 27 and 29). The disk 1150 is connected to the inner hub 1112 by a rail 1151. The disk 1150 is intended to selectively contact an end surface of the arcuate shaped portion 1125 of one of the plungers 1120, 1130, 1140.

In one embodiment, the engagement between the disk 1150 and the plunger is generally one of a male/female type. More specifically, the disk 1150 has a male feature that can be received within a female feature, in the form of a recess 1153, formed along an end surface of the arcuate shaped portion 1125 of the selected plunger. This can provide additional engagement between the plunger engaging member 1110 and the respective plunger. The plunger engaging member 1110 functions in the same way as the plunger engaging member 490 in that rotation of the outer selector part 1010 causes rotation of the outer selector part 1010 which in turn causes rotation of the disk 1150. When the outer selector part 1010 is in one of the plunger engaged positions, the disk 1150 is in direct contact and engagement with one of the respective plungers. In this position, the plunger engaging member 1110 can be driven into contact with the respective plunger as a result of a trigger action (movement) as described herein with respect to the first embodiment.

As in the first embodiment of dispenser 100, the selector assembly of the dispenser 1000 includes the first housing part 410 and the second housing part 420 that mate together to form a hollow shell-like structure that surrounds the inner housing 215 and is coupled to both the inner housing 215 and the trigger 300. One difference is that the second housing part 420 does not include the slots 425 since the locking part 480 has been eliminated. The coupled outer selector part 1010 and the plunger engaging member 1110 are received within a cavity formed at one end of the second housing part 420. The outer selector part 1010 is held into the housing, while still being able to rotate, by sandwiching the second housing part 420 with the plunger engaging member 1110. The plunger engaging member 1110 sits inside the second housing part 420 and is secured with a fastener (e.g., a screw). The outer selector part 1010 has a male part which is in the form of the center hub 474 that is inserted through the second housing part 420, through the plunger engaging member 1110, and is then fastened with a fastener, e.g., a screw. That assembly is then placed inside the housing and is held together by the body being fastened together. As also described and illustrated, the plungers 1120, 1130, 1140 also rest inside the second housing part 420.

As shown in FIG. 21, the retainer 460 can be provided to maintain the plungers 1120, 1130, 1140 in place while permitting sliding axial movement thereof. The retainer 460 thus has a series of (arcuate shaped) notches formed therein to accommodate the arcuate shape portions 1125 of plungers 1120, 1130, 1140.

As shown in FIGS. 21-24 and 26, the nozzle 340 includes a plurality of gaskets 1200. The gaskets 1200 are provided in the nozzle 340 for sealing the nozzle 340 to prevent unwanted leakage. When the nozzle collar 340 is turned, the nozzle 340 retracts and the gaskets 1200 seal the fluid pathways. As shown, each flow path includes a pair of gaskets 1200 and thus, there are a total of six gaskets 1200. The gaskets 1200 are annular shaped and function much like a gasket in a faucet.

FIGS. 18A and 18B illustrate another aspect of the second embodiment in that the valve seat 640 is formed in a different component than in the first embodiment. In particular, the valve seat 640 is formed in an upper end section of the first upper fluid connector 265 that mates with a bottom end of the main conduit member 260 and mates with a top end of the conduit 11. Similarly, the second upper fluid connector associated with the second reservoir and the third upper fluid connector associated with the third reservoir also include valve seats 640. The valve seats 640 and valves 630 operate in the same manner as described with respect to the first embodiment.

The operation of the dispenser 1000 is otherwise the same or similar to the dispenser 100 with like parts and like assemblies being shown in the set of figures relating to the dispenser 100 and the set of figures relating to the dispenser 1000. In particular, the trigger action causes the selector assembly to be pulled forward into contact with a select one of the plungers. The plunger is accordingly driven with the corresponding plunger receiving cavity causing the fluid contained thereto to be evacuated along the exit flow path and out the nozzle.

Notably, the figures and examples above are not meant to limit the scope of the present invention to a single embodiment, as other embodiments are possible by way of interchange of some or all of the described or illustrated elements. Moreover, where certain elements of the present invention can be partially or fully implemented using known components, only those portions of such known components that are necessary for an understanding of the present invention are described, and detailed descriptions of other portions of such known components are omitted so as not to obscure the invention. In the present specification, an embodiment showing a singular component should not necessarily be limited to other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present invention encompasses present and future known equivalents to the known components referred to herein by way of illustration.

The foregoing description of the specific embodiments will so fully reveal the general nature of the invention that others can, by applying knowledge within the skill of the relevant art(s) (including the contents of the documents cited and incorporated by reference herein), readily modify and/or adapt for various applications such specific embodiments, without undue experimentation, without departing from the general concept of the present invention. Such adaptations and modifications are therefore intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one skilled in the relevant art(s).

While various embodiments of the present invention have been described above, it should be understood that they have been presented by way of example, and not limitation. It would be apparent to one skilled in the relevant art(s) that various changes in form and detail could be made therein without departing from the spirit and scope of the invention. Thus, the present invention should not be limited by any of the above-described exemplary embodiments, but should be defined only in accordance with the following claims and their equivalents.

What is claimed is:

1. A multi reservoir dispenser comprising:

a first reservoir for holding a first fluid;

a second reservoir for holding a second fluid;

a pump mechanism in fluid communication with the first reservoir via a first flow path and in fluid communication with the second reservoir via a second flow path, the pump mechanism including a pivotable trigger and a first plunger cavity that is disposed along the first flow path for receiving the first fluid and a second plunger cavity for receiving the second fluid, the pump mechanism includes a first plunger that is disposed and movable within the first plunger cavity and a second plunger that is disposed and movable within the second plunger cavity;

a nozzle having a first orifice in fluid communication with the first flow path and a second orifice in fluid communication with the second flow path;

a selectable actuator that is movable between: (a) a first position in which only the first plunger of the pump mechanism is actuated for discharging only the first fluid through the first orifice of the nozzle by causing the first fluid to flow along the first flow path; and (b) a second position in which only the second plunger of the pump mechanism is actuated for discharging only the second fluid through the second orifice of the nozzle by causing the second fluid to flow along the second flow path;

wherein the first flow path and the second flow path are fluidly isolated from one another along an entire length from the first reservoir to the first orifice and from the second reservoir to the second orifice, respectively.

2. The dispenser of claim 1, further including a third reservoir for holding a third fluid and the pump mechanism is in fluid communication with the third reservoir via a third flow path, the pump mechanism including a third plunger cavity that is disposed along the third flow path for receiving the third fluid and a third plunger is disposed and movable within the third plunger cavity, the nozzle having a third orifice in fluid communication with the third flow path, wherein the selectable actuator is movable to: (a) a third position in which only the third plunger of the pump mechanism is actuated for discharging only the third fluid through the third orifice of the nozzle by causing the third fluid to flow along the third flow path, wherein the third flow path is fluidly isolated from both the first flow path and the second flow path along an entire length from the third reservoir to the third orifice.

3. The dispenser of claim 1, wherein a first conduit is disposed within the first reservoir and is fluidly coupled to an inner pump housing in which a portion of the first flow path is defined, the first plunger receiving cavity being formed within the inner pump housing, wherein a first valve is disposed between the first plunger receiving cavity and the nozzle and a second valve is disposed between the first conduit and the first plunger receiving cavity, wherein in a first operating position of the trigger, the first valve is in a closed position and the second valve is in an open position to allow the first fluid to be drawn from the first reservoir to the first plunger receiving cavity and in a second operating position of the trigger, the first valve is in an open position and the second valve is in a closed position to allow the first fluid to be expelled from the first plunger cavity through the first orifice of the nozzle, wherein a second conduit is disposed within the second reservoir and is fluidly coupled to the inner pump housing in which a portion of the second flow path is defined, the second plunger receiving cavity being formed within the inner pump housing, wherein a third valve is disposed between the second plunger receiving cavity and the nozzle and a fourth valve is disposed between the second conduit and the second plunger receiving cavity, wherein in the first operating position of the trigger, the third valve is in a closed position and the fourth valve is in an open position to allow the first fluid to be drawn from the second reservoir to the second plunger receiving cavity and in the second operating position of the trigger, the third valve is in an open position and the fourth valve is in a closed position to allow the second fluid to be expelled from the second plunger cavity through the second orifice of the nozzle.

4. The dispenser of claim 3, wherein each of the first valve and the third valve comprises a spring biased ball valve and each of the second valve and the fourth valve comprises a ball valve.

5. The dispenser of claim 3, wherein the inner pump housing includes a first inner conduit in which the first valve is disposed and that is located upstream of the first plunger cavity and a second inner conduit in which the second valve is disposed and that is located downstream of the first plunger cavity, the inner pump housing including a third inner conduit in which the third valve is disposed and that is located upstream of the second plunger cavity and a fourth inner conduit in which the fourth valve is disposed and that is located downstream of the second plunger cavity.

6. The dispenser of claim 1, wherein the first plunger cavity includes a first biasing member that applies a force to the first plunger and the second plunger cavity includes a second biasing member that applies a force to the second plunger.

7. The dispenser of claim 1, wherein the selectable actuator includes a selector housing formed of a first housing part and a second housing part that mate together to form a hollow shell-like structure that surrounds an inner pump housing, the selector housing being coupled to both the inner pump housing and the trigger, the selector housing being coupled to the trigger such that movement of the trigger is directly translated into movement of the selector housing relative to the inner pump housing.

8. The dispenser of claim 1, wherein the selectable actuator includes a rotatable selector that is accessible to a user to move the selectable actuator between the first and second positions.

9. The dispenser of claim 8, wherein the rotatable selector includes an outer selector part and a plunger engaging member that are all coupled together to form an assembled rotatable selector, wherein the outer selector part and the plunger engaging member are directly coupled to one another and rotate in unison relative to a selector housing formed of a first housing part and a second housing part that mate together to form a hollow shell-like structure that surrounds an inner pump housing, the selector housing being coupled to the trigger such that movement of the trigger is directly translated into movement of movement of the selector housing relative to the inner pump housing.

10. The dispenser of claim 9, wherein the outer selector part includes first indicia representing the first reservoir and second indicia representing the second reservoir, wherein registration between an arrow formed on a main housing body that surrounds the selector housing and the first indicia is indicative that the selectable actuator is in the first position and registration between the arrow and the second indicia is indicative that the selectable actuator is in the second position.

11. The dispenser of claim 9, wherein the outer selector part comprises a hollow member with a central boss extending outwardly therefrom, the plunger engaging member being rotatable coupled to an inner face of the outer selector part and including a protrusion that selectively engages only one of the first plunger and the second plunger when placed into a plunger engaging position.

12. The dispenser of claim 11, wherein the plunger engaging member includes a hub from which a plurality of flexible second fingers project and are disposed within a circumferential track formed along the inner face of the outer selector part to further couple the plunger engaging member to the outer selector part and to allow the plunger engaging member to rotate in unison with the outer selector part, wherein the protrusion is disposed radially from the hub.

13. The dispenser of claim 12, wherein the hub has a bore through which a fastener can pass to couple the plunger engaging member to the outer selector part.

14. The dispenser of claim 12, wherein each of the first plunger and the second plunger includes a side portion that has a recess formed in a surface that faces the plunger engaging member, the protrusion of the plunger engaging member being configured to mate with the recess for further coupling between the plunger engaging member and one of the first plunger and the second plunger.

15. The dispenser of claim 12, wherein the protrusion is connected to the hub by a rail, the protrusion projecting forward of the rail.

16. A multi reservoir dispenser comprising:

a first reservoir for holding a first fluid;

a second reservoir for holding a second fluid;

a third reservoir for holding a third fluid;

a pump mechanism in fluid communication with the first reservoir via a first flow path, is in fluid communication with the second reservoir via a second flow path, and is in fluid communication with the third reservoir via a third flow path, the pump mechanism including a pivotable trigger and a first plunger cavity that is disposed along the first flow path for receiving the first fluid, a second plunger cavity for receiving the second fluid, and a third plunger cavity for receiving the third fluid, the pump mechanism includes a first plunger that is disposed and movable within the first plunger cavity, a second plunger that is disposed and movable within the second plunger cavity, and a third plunger that is disposed and movable within the third plunger cavity;

a nozzle having a first orifice in fluid communication with the first flow path, a second orifice in fluid communication with the second flow path, and a third orifice in fluid communication with the third flow path;

a selectable actuator that is movable between: (a) a first position in which only the first plunger of the pump mechanism is actuated for discharging only the first fluid through the first orifice of the nozzle by causing the first fluid to flow along the first flow path, (b) a second position in which only the second plunger of the pump mechanism is actuated for discharging only the second fluid through the second orifice of the nozzle by causing the second fluid to flow along the second flow path, (c) a third position in which only the third plunger of the pump mechanism is actuated for discharging only the third fluid through the third orifice of the nozzle by causing the third fluid to flow along the third flow path;

wherein the first flow path, the second flow path, and the third flow paths are fluidly isolated from one another along an entire length from the first reservoir to the first orifice, from the second reservoir to the second orifice, and from the third reservoir to the third orifice, respectively.

17. The dispenser of claim 16, wherein the selectable actuator includes a selector housing that surrounds an inner pump housing in which the first plunger receiving cavity and the second plunger receiving cavity are formed, the selector housing being coupled to the trigger such that movement of the trigger is directly translated into axial movement of movement of the selector housing and selectable actuator relative to the inner pump housing.

18. The dispenser of claim 16, wherein the selectable actuator is configured such that the selectable actuator can only engage one of the first plunger and the second plunger at one time.

* * * * *